US008072399B2

(12) United States Patent
Iida et al.

(10) Patent No.: US 8,072,399 B2
(45) Date of Patent: Dec. 6, 2011

(54) DISPLAY DEVICE, METHOD OF DRIVING SAME, AND ELECTONIC DEVICE

(75) Inventors: Yukihito Iida, Kanagawa (JP); Katsuhide Uchino, Kanagawa (JP); Tetsuro Yamamoto, Kanagawa (JP)

(73) Assignee: Sony Corporation, Tokyo (JP)

( * ) Notice: Subject to any disclaimer, the term of this patent is extended or adjusted under 35 U.S.C. 154(b) by 1166 days.

(21) Appl. No.: 11/878,671

(22) Filed: Jul. 26, 2007

(65) Prior Publication Data

US 2008/0030436 A1 Feb. 7, 2008

(30) Foreign Application Priority Data

Aug. 1, 2006 (JP) ..... 2006-209326

(51) Int. Cl.
*G09G 3/30* (2006.01)

(52) U.S. Cl. ..... 345/77; 345/76; 345/89; 345/204

(58) Field of Classification Search ..... 345/77, 345/76, 89, 204
See application file for complete search history.

(56) References Cited

U.S. PATENT DOCUMENTS

| | | | | |
|---|---|---|---|---|
| 2002/0067327 | A1* | 6/2002 | Ozawa et al. | 345/89 |
| 2004/0070557 | A1* | 4/2004 | Asano et al. | 345/76 |
| 2006/0125740 | A1* | 6/2006 | Shirasaki et al. | 345/77 |

FOREIGN PATENT DOCUMENTS

| | | |
|---|---|---|
| JP | 60-134293 | 7/1985 |
| JP | 63-287829 | 11/1988 |
| JP | 2003-255856 | 9/2003 |
| JP | 2003-271095 | 9/2003 |
| JP | 2004-029791 | 1/2004 |
| JP | 2004-093682 | 3/2004 |
| JP | 2004-133240 | 4/2004 |
| JP | 2006-133542 | 5/2006 |

OTHER PUBLICATIONS

Japanese Office Action dated Jun. 3, 2008 for corresponding Japanese Application No. 2006-209326.

* cited by examiner

*Primary Examiner* — Richard Hjerpe
*Assistant Examiner* — Leonid Shapiro
(74) *Attorney, Agent, or Firm* — Rader, Fishman & Grauer PLLC

(57) ABSTRACT

A display device is disclosed. The display device includes: a pixel array portion and a driver portion for driving the pixel array portion. The pixel array portion has rows of scanning lines, columns of signal lines, pixels arranged in rows and columns at intersections of the scanning lines and the signal lines, and power lines disposed in a corresponding manner to the rows of the pixels. The driver portion includes a main scanner, a power-supply scanner, and a signal selector. Each of the pixels includes light-emitting devices, a sampling transistor, a driving transistor, and a retaining capacitor.

8 Claims, 28 Drawing Sheets

DISPLAY DEVICE, METHOD OF DRIVING SAME, AND ELECTONIC DEVICE

CROSS REFERENCES TO RELATED APPLICATION

The present invention contains subject matter related to Japanese Patent Application JP2006-209326 filed in the Japanese Patent Office on Aug. 1, 2006, the entire contents of which are incorporated herein by reference.

BACKGROUND OF THE INVENTION

1. Field of the Invention

The present invention relates to an active matrix display device using light-emitting devices at pixels and also to a method of driving the display device. Furthermore, the invention relates to an electronic device incorporating such a display device.

2. Description of the Related Art

In recent years, self-luminous flat panel displays using organic electroluminescent devices (OEDs) as light-emitting devices have been developed vigorously. An OED is a device making use of the phenomenon that electroluminescence occurs when an electric field is applied to an organic thin film. Since OEDs are driven when a voltage of less than 10 V is applied, the devices are low power consumption devices. Furthermore, because OEDs are self-luminous devices, no illumination may, be required. Consequently, it is easy to fabricate them with reduced weight and thickness. In addition, the response speeds of OEDs are very fast, on the order of microseconds. Hence, when motion pictures are displayed, there is no afterimage.

Active matrix display devices using thin-film transistors (TFTs) formed at pixels as driver elements are being developed especially vigorously among self-luminous flat panel displays using OEDs at pixels. Active matrix self-luminous flat panel displays are described, for example, in JP-A-2003-255856, JP-A-2003-271095, JP-A-2004-133240, JP-A-2004-029791 and JP-A-2004-093682 (Patent References 1-5).

SUMMARY OF THE INVENTION

However, in related-art active-matrix self-luminous flat panel displays, transistors for driving the light-emitting devices are not uniform in threshold voltage and mobility due to process variations. Furthermore, the characteristics of the organic electroluminescent devices vary with time. These variations in the characteristics of the driving transistors and variations in the characteristics of the OEDs affect the output brightness. In order to make uniform the output brightness over the whole screen of the display device, it may be necessary to correct the variations in the characteristics of the transistor and OED within each pixel circuit. A display device having a function of making such a correction at each pixel has been heretofore proposed. However, the pixel circuit having the known correcting function as described above would need lines for supplying corrective potentials, switching transistors, and switching pulses. That is, the pixel circuit is complex in configuration. An improvement of the resolution of the display device is hindered by the fact that the pixel circuit is made up of a large number of components.

In view of the foregoing technical issues with the related art, it is desirable to provide a display device using a simplified pixel circuit thereby to permit a higher resolution. It is also desirable to provide a method of driving this display device. Especially, it is desirable to provide a display device and a driving method capable of reliably correcting variations among threshold voltages for driving transistors.

A display device according to one embodiment of the present invention is fundamentally composed of a pixel array portion and a driver portion for driving the pixel array portion. The pixel array portion has rows of scanning lines, columns of signal lines, pixels arranged in rows and columns at intersections of the scanning lines and signal lines, and power lines arranged in a corresponding manner to the columns of the pixels. The driver portion has a main scanner for supplying a sequential control signal to the scanning lines in horizontal periods to scan the rows of pixels by a line sequential scanning method, a power-supply scanner for supplying a power-supply voltage switched between a first potential and a second potential to the power lines in step with the line sequential scanning, and a signal selector for supplying a selector output signal to the columns of signal lines in step of the line sequential scanning. The selector output signal is switched between a signal potential becoming a video signal within each horizontal period and a reference potential.

Each of the pixels includes light-emitting devices, sampling transistor, a driving transistor, and a retaining capacitor. The gate of the sampling transistor is connected with the corresponding one of the scanning lines. One of the source and drain is connected with the corresponding one of the signal lines, while the other is connected with the gate of the driving transistor. One of the source and drain of the driving transistor is connected with the light-emitting devices, whereas the other is connected with the power line. The retaining capacitor is connected between the source and gate of the driving transistor.

In this display device, the sampling transistor is brought into conduction according to the control signal supplied from the scanning line, samples the signal potential supplied from the signal line, and retains the potential into the retaining capacitor. The driving transistor receives an electrical current from the power line at the first potential and supplies a driving current to the light-emitting devices according to the retained signal potential. The main scanner outputs a control signal to drive the sampling transistor into conduction during a first period in which the power line is at the first potential and, at the same time, the signal line is at the reference potential. Consequently, a voltage corresponding to a threshold voltage for the driving transistor is retained in the retaining capacitor. That is, an operation for correcting the threshold voltage is performed. The main scanner repeatedly performs the operation for correction of the threshold voltage in plural horizontal periods preceding the sampling of the signal potential. This assures that the voltage corresponding to the threshold voltage for the driving transistor is retained in the retaining capacitor.

Preferably, the main scanner outputs the control signal to drive the sampling transistor into conduction prior to the operation for correction of the threshold voltage in a time period in which the power line is at the second potential and, at the same time, the signal line is at the reference potential. Consequently, the gate of the driving transistor is set to the reference potential. Also, the source is set to the second potential. The main scanner outputs a second control signal shorter in pulse width than the first period to the scanning line to bring the sampling transistor into conduction when the signal line is at the signal potential. In consequence, the signal potential is corrected for the mobility of the driving transistor for holding the signal potential into the retaining capacitor. At the instant when the signal potential is retained into the retaining capacitor, the main scanner brings the sampling transistor out of conduction. The gate of the driving transistor is electrically disconnected from the signal line. As a result, the gate potential is made to respond to a variation of the source potential of the driving transistor, thus maintaining constant the voltage between the gate and source.

One embodiment of the present invention provides an active matrix display device using light-emitting devices, such as organic electroluminescent devices (OEDs), at pixels. Each pixel has at least a function of correcting the threshold voltage for the driving transistor. Preferably, the pixel has the function of correcting the mobility of the driving transistor and the function of correcting for timewise variations in the characteristics of the OEDs (bootstrap operation). As a result, a high image quality can be obtained. To incorporate these corrective functions, the power-supply voltage supplied to each pixel is used as a switching pulse. This eliminates switching transistors, which would normally be used to correct the threshold voltage, and scanning lines, which control the gate of the switching transistors. As a result, the number of elements constituting the pixel circuit and the number of lines can be reduced greatly. Hence, the pixel area can be reduced. Consequently, a higher resolution of the display can be accomplished. In the related-art pixel circuit having such corrective functions, there are many elements, and so the layout area is large. Consequently, the related-art pixel circuit is unsuited for a higher resolution of display devices. In one embodiment of the present invention, the number of the constituent elements and the number of lines are reduced by switching the power-supply voltage. The pixel layout area can be reduced. Thus, a high-quality, high-definition flat display can be offered.

In one embodiment of the present invention, the operation for correcting the threshold voltage is repeatedly performed in plural horizontal periods preceding sampling of the signal potential. This assures that a voltage corresponding to the threshold voltage for the driving transistor is retained in the retaining capacitor. In one embodiment of the invention, a correction of the threshold voltage for the driving transistor is carried out by plural discrete operations and so the total time to correct the threshold voltage can be secured sufficiently. The voltage corresponding to the threshold voltage for the driving transistor can be reliably retained in the retaining capacitor previously. The voltage which is retained in the retaining capacitor and which corresponds to the threshold voltage is added to the signal potential similarly sampled and retained into the retaining capacitor. This is added to the gate of the driving transistor. The voltage which is added to the sampled signal potential and which corresponds to the threshold voltage just cancels the threshold voltage for the driving transistor. Therefore, a driving current corresponding to the signal potential can be supplied to the light-emitting devices without being affected by the variations. For this purpose, it is important that the voltage corresponding to the threshold voltage be retained in the retaining capacitor reliably. In one embodiment of the present invention, writing of the voltage corresponding to the threshold voltage is carried out by plural discrete repetitive operations. In this way, a time for the writing is secured sufficiently. Because of this configuration, a brightness nonuniformity, especially at low gray levels, can be suppressed.

DESCRIPTION OF THE PREFERRED EMBODIMENTS

Figure 1:
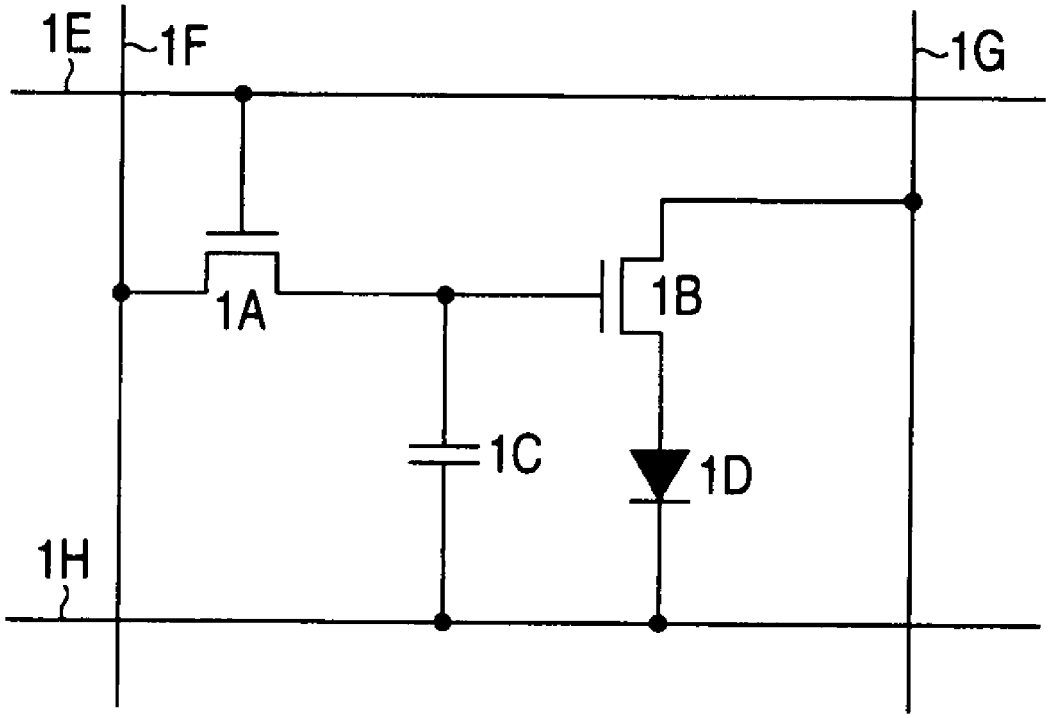
FIG. 1 is a circuit diagram of a general pixel structure.

Embodiments of the present invention are hereinafter described in detail with reference to the drawings. To facilitate understanding the present invention and make clear the background of the invention, a general structure of a display device is briefly described by referring to FIG. 1. FIG. 1 is a schematic circuit diagram of one pixel of a general display device. As shown, in this pixel circuit, a transistor 1A for sampling is disposed at the intersection of a scanning line 1E and a signal line 1F which are orthogonal to each other. The transistor 1A is of the N type. The gate of the transistor is connected with the scanning line 1E, while the drain is connected with the signal line 1F. One electrode of a retaining capacitor 1C and the gate of a driving transistor 1B are connected with the source of the sampling transistor 1A. The driving transistor 1B is of the N type. A power-supply line 1G is connected with the drain of the driving transistor 1B. The anode of a light-emitting device 1D is connected with the source of the transistor 1B. The other electrode of the capacitor 1C and the cathode of the light-emitting device 1D are connected with a grounding line 1H.

Figure 2:
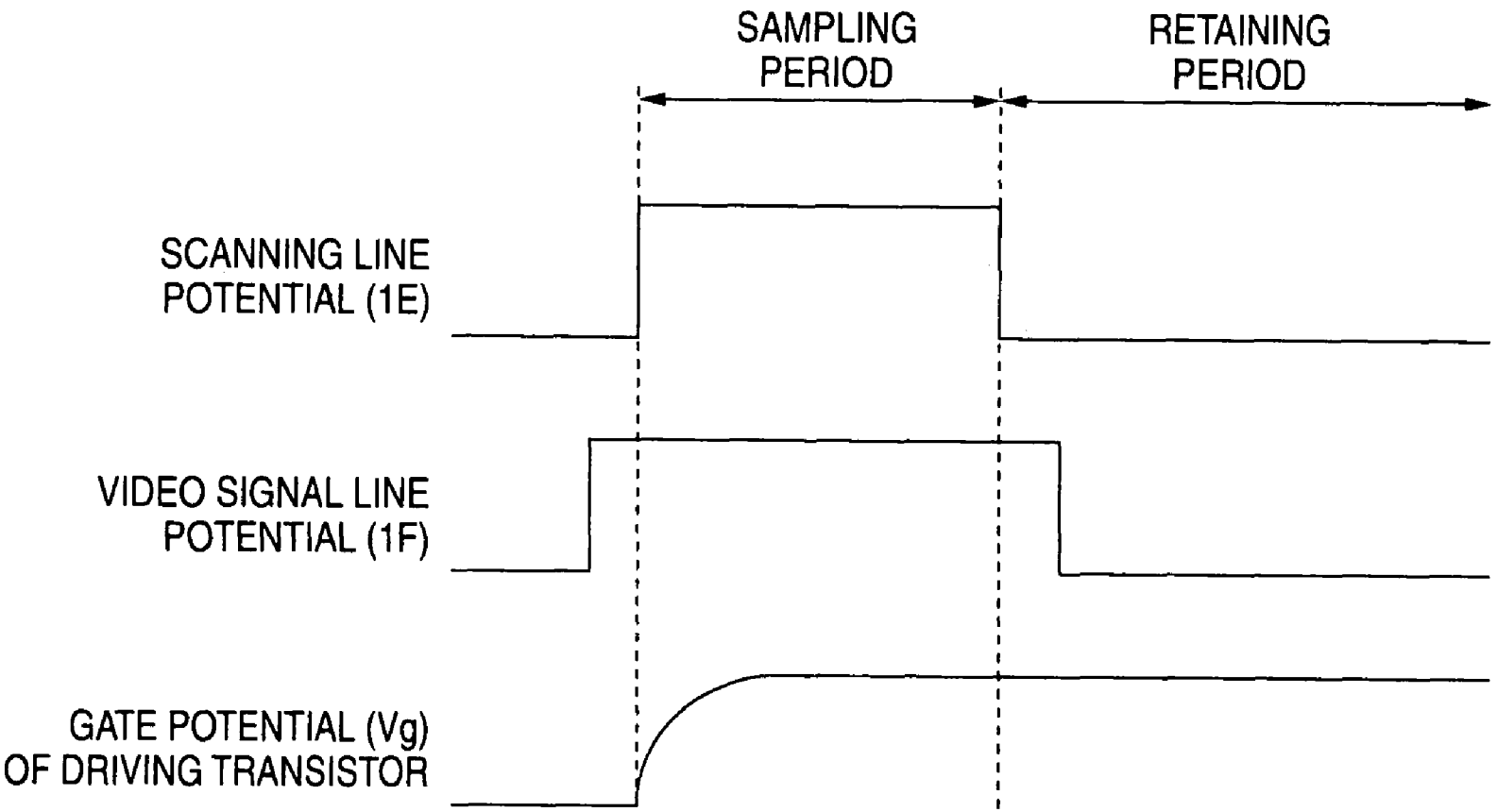
FIG. 2 is a timing chart illustrating the operation of the pixel circuit shown in FIG. 1.

FIG. 2 is a timing chart illustrating the operation of the pixel circuit shown in FIG. 1. The timing chart illustrates the operation for causing the light-emitting device 1D made of an organic electroluminescent device to emit light by sampling the potential of the video signal supplied from the signal line 1F (potential at the video signal line). The potential at the scanning line 1E (scanning line potential) goes to a high level. As a result, the sampling transistor 1A is turned on. The potential at the video signal line is stored in the retaining capacitor 1C. Consequently, the gate potential Vg of the driving transistor 1B begins to rise and starts to supply a drain current. The anode potential of the light-emitting device 1D rises, starting the emission of light. Then, if the scanning line potential goes to a low level, the potential at the video signal line is retained in the retaining capacitor 1C. The gate potential of the driving transistor 1B is kept constant. The emission brightness is kept constant up to the next frame.

However, the individual pixels vary in characteristics, such as threshold voltage and mobility, due among respective pixels to variations in the process for fabricating the driving transistor 1B. Because of the variations in the characteristics, if the same gate potential is applied to the driving transistor 1B, the drain current (driving current) varies among the pixels. This produces variations in the output brightness. Furthermore, because of timewise variations in the characteristics of the light-emitting device 1D made of an organic electroluminescent device or the like, the anode potential of the light-emitting device 1D varies. This causes variations in the gate-source voltage of the driving transistor 1B, resulting in variations in the drain current (driving current). Variations in the driving current produced by these various causes appear as variations in output brightness among individual pixels. Consequently, the image quality is deteriorated.

Figure 3A:
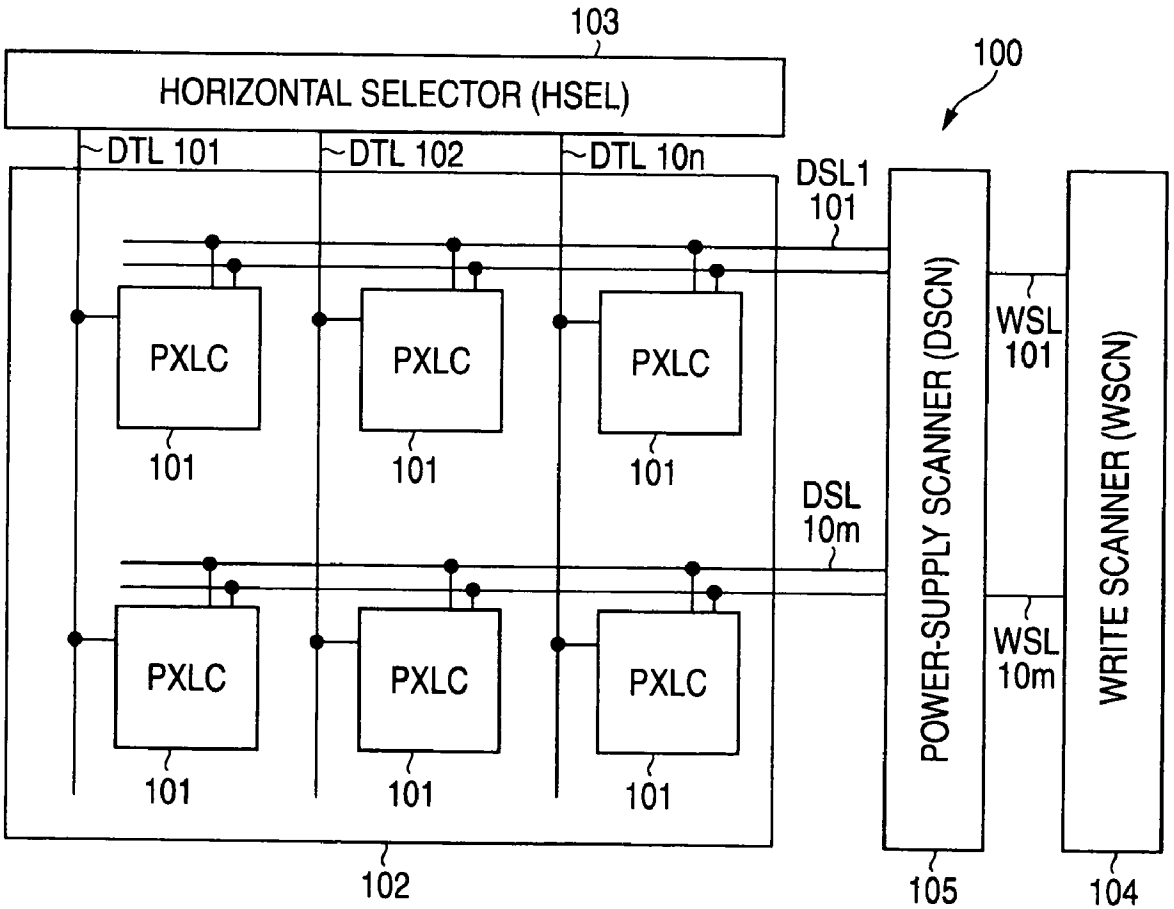
FIG. 3A is a block diagram showing the whole structure of a display device according to one embodiment of the present invention.

FIG. 3A is a block diagram of the whole structure of a display device according to an embodiment of the present invention. As shown, the present display device, generally indicated by reference numeral 100, includes a pixel array portion 102 and driver circuitry (103, 104, 105) for driving the pixel array portion. The pixel array portion 102 has rows of scanning lines WSL101-WSL10*m*, rows of signal lines DTL101-DTL10*n*, a matrix of pixels (PXLC) 101 arranged at the intersections of the scanning lines and signal lines, and power lines DSL101-DSL10*m* arranged in a corresponding manner to the rows of pixels 101. The driver circuitry (103, 104, 105) has a main scanner (write scanner WSCN) 104 for supplying a sequential control signal to each of the scanning lines WSL101-WSL10*m* during each horizontal period (1H) to scan the rows of pixels 101 in a line sequential manner, a power-supply scanner (DSCN) 105 for supplying a power-supply voltage to each of the power lines DSL101-DSL10*m* in step with the line sequential scanning, and a signal selector (horizontal selector HSEL) 103 for supplying a selector output signal to the columns of signal lines DTL101-DTL10*m* in step with the line sequential scanning during each horizontal period 1H. The power-supply voltage is switched between first and second potentials. The selector output signal is switched between a signal potential becoming a video signal and a reference potential.

Figure 3B:
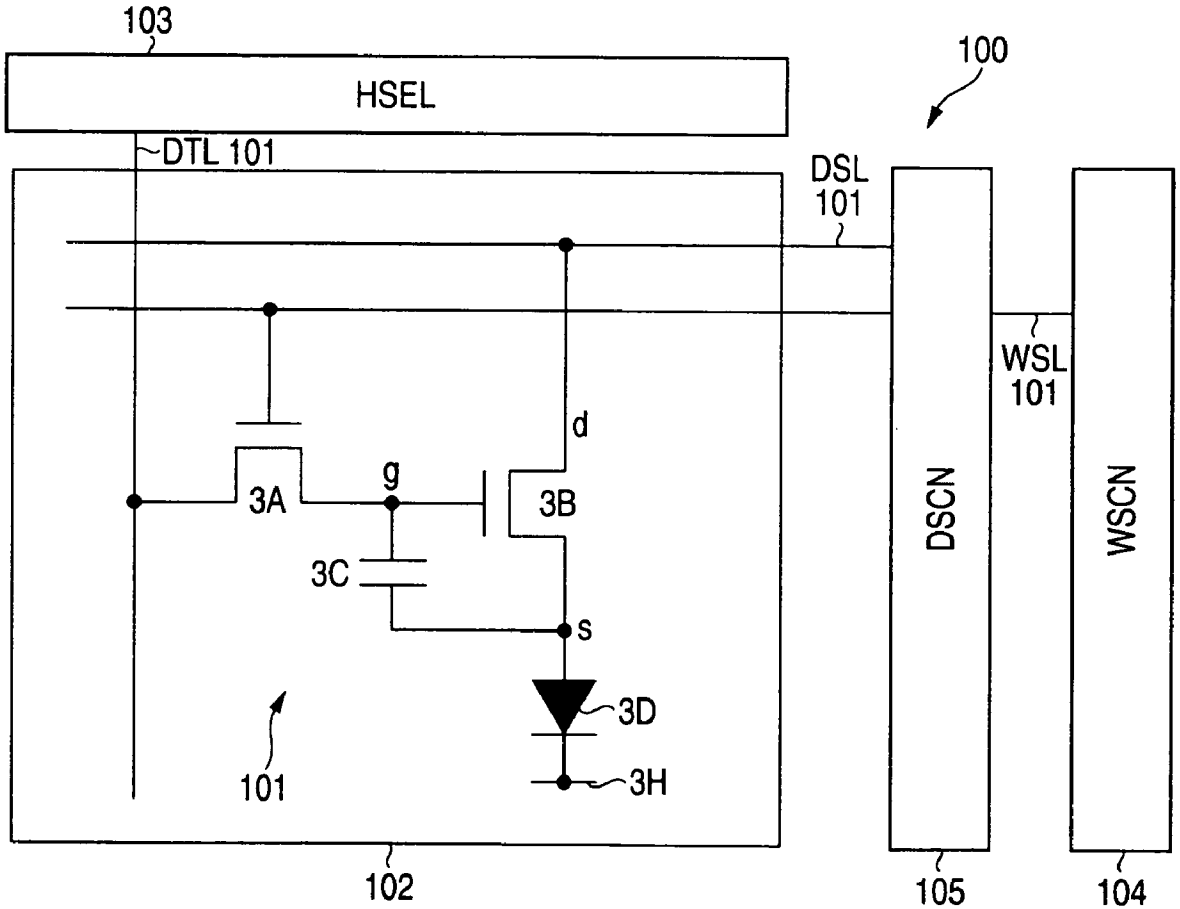
FIG. 3B is a circuit diagram of one example of a display device according to one embodiment of the invention.

FIG. 3B is a-circuit diagram showing the details of the structure of the pixels 101 contained in the display device 100 shown in FIG. 3A and the connective relationship. As shown, one pixel 101 includes a light-emitting device 3D typified by an organic electroluminescent device, a transistor 3A for sampling, a driving transistor 3B, and a retaining capacitor 3C. The gate of the sampling transistor 3A is connected with the corresponding scanning line WSL101. One of the source and drain is connected with the corresponding signal line DTL101. The other is connected with the gate g of the driving transistor 3B. One of the source s and drain d of the driving transistor 3B is connected with the light-emitting device 3D, while the other is connected with the corresponding power line DSL101. In the present embodiment, the drain d of the driving transistor 3B is connected with the power line DSL101, while the source is connected with the anode of the light-emitting device 3D. The cathode of the light-emitting device 3D is connected with a grounding line 3H. The grounding line 3H is connected with all the pixels 101 in common. The retaining capacitor 3C is connected between the source s and gate g of the driving transistor 3B.

In this structure, the sampling transistor 3A conducts in response to the control signal supplied from the scanning line WSL101, samples the signal potential supplied from the signal line DTL101, and retains the sampled potential into the retaining capacitor 3C. The driving transistor 3B receives an electrical current from the power line DSL101 at the first potential and supplies a driving current to the light-emitting device 3D in response to the signal potential retained in the retaining capacitor 3C. The main scanner 104 outputs a control signal to the sampling transistor 3A to bring it into conduction during a period in which the power line DSL101 is at the first potential and, at the same time, the signal line DTL101 is at the reference potential to perform an operation for correcting the threshold voltage for retaining the voltage corresponding to the threshold voltage Vth for the driving transistor 3B into the retaining capacitor 3C.

As one embodiment of the present invention, the main scanner 104 repeatedly performs an operation for correcting the threshold voltage in plural horizontal periods preceding sampling of the signal potential to ensure that a voltage corresponding to the threshold voltage Vth for the driving transistor 3B is retained in the retaining capacitor 3C. In this way, in the embodiment of the invention, a sufficiently long writing period is secured by performing plural operations for correcting the threshold voltage. Consequently, the voltage corresponding to the threshold voltage for the driving transistor can be reliably and previously retained in the retaining capacitor 3C. The retained voltage corresponding to the threshold voltage is used to cancel the threshold voltage for the driving transistor. Accordingly, if the threshold voltage for the driving transistor varies among the individual pixels, the variations among the pixels are completely canceled out. As a result, the uniformity of the image is enhanced. Especially, the brightness nonuniformity that tends to appear at low gray levels represented by the signal potential can be prevented.

Preferably, the main scanner 104 outputs a control signal to bring the sampling transistor 3A into conduction during a period in which the power line DSL101 is at the second potential and, at the same time, the signal line DTL101 is at the reference potential prior to the operation for correcting the threshold voltage. Consequently, the gate g of the driving transistor 3B is set to the reference potential. The source s is set to the second potential. The operations for resetting the gate potential and source potential ensure that an operation for correcting the threshold voltage, as described later, is performed.

The pixel 101 shown in FIG. 3B has a mobility-correcting function in addition to the aforementioned function of correcting the threshold voltage. That is, in order to bring the sampling transistor 3A into conduction during the period in which the signal line DTL101 is at the signal potential, the main scanner 104 outputs a control signal having a pulse width shorter than the above-described period to the scanning line WSL101. Therefore, when the signal potential is retained into the retaining capacitor 3C, the signal potential is simultaneously corrected for the mobility μ of the driving transistor 3B.

Furthermore, the pixel circuit 101 shown in FIG. 3B has a bootstrap function. That is, when the signal potential is retained into the retaining capacitor 3C, the main scanner (WSCN) 104 ceases to apply the control signal to the scanning line WSL101, bringing the sampling transistor 3A out of conduction. The gate g of the driving transistor 3B is electrically disconnected from the signal line DTL101. Consequently, the gate potential (Vg) responds to a variation of the source potential (Vs) of the driving transistor 3B. As a result, the voltage Vgs between the gate g and source s can be maintained constantly.

Figure 4A:
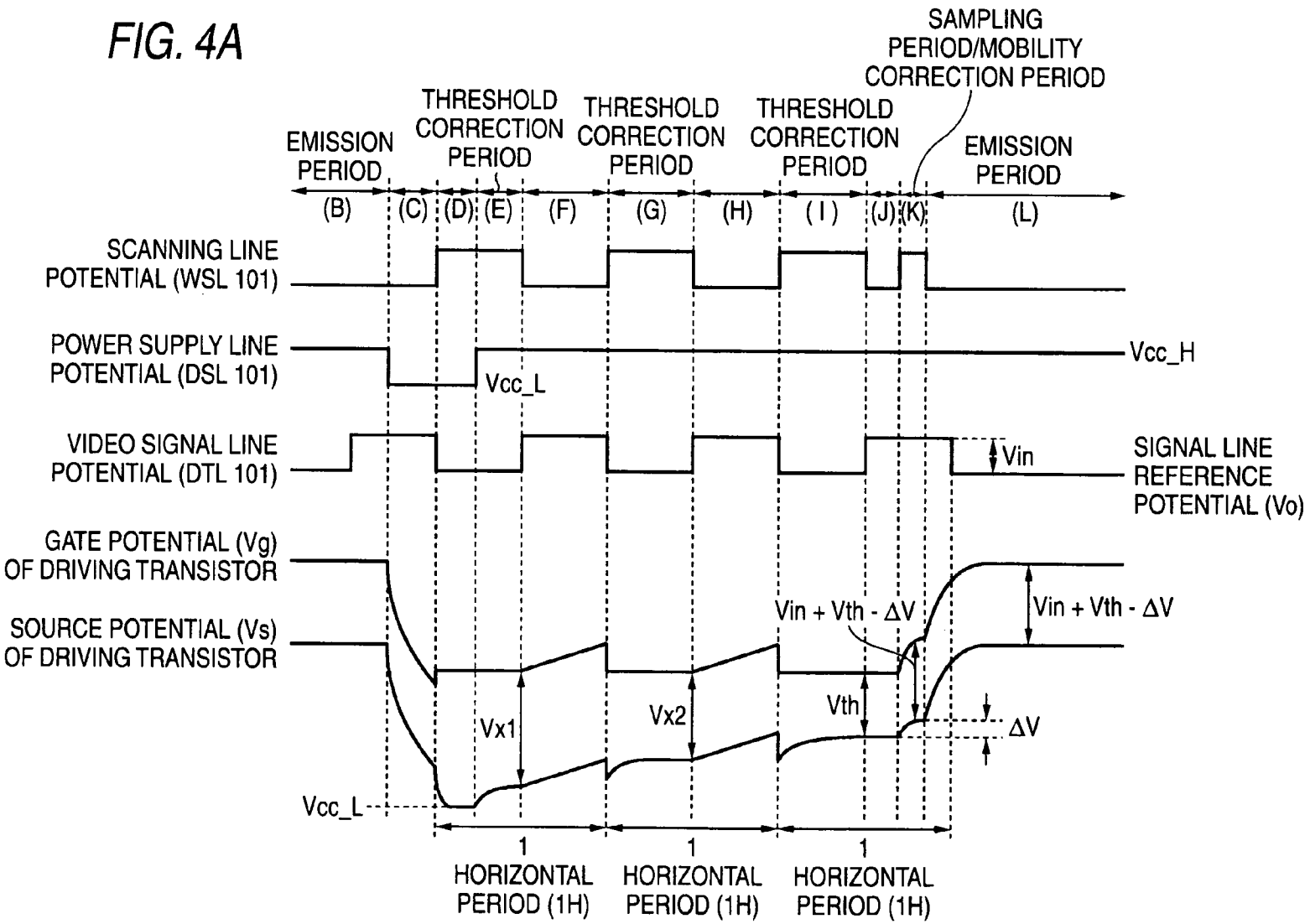
FIG. 4A is a timing chart illustrating the operation of the example shown in FIG. 3B.

FIG. 4A is a timing chart illustrating the operation of the pixel 101 shown in FIG. 3B. The time axis is taken as a common axis. Variations in the potential at the scanning line WSL101, variations in the potential at the power line DSL101, and variations of the potential at the signal line DTL101 are shown. Variations in the gate potential Vg of the driving transistor 3B and variations in the source potential Vs are shown beside those variations.

In the timing chart, the time is conveniently partitioned into periods (B)-(L) in step with the progress of the operation of the pixel 101. In the emission period (B), the light-emitting device 3D is emitting light. Then, the process enters a new field of a line sequential scanning operation. In the first period (C), the power line DSL101 is switched from a high potential (Vcc_H) to a low potential (Vcc_L). Then, in a preparatory period (D), the gate potential Vg of the driving transistor 3B is reset to the reference potential Vo. Furthermore, the source potential Vs is reset to the low potential Vcc_L of the power line DTL101. Subsequently, the first operation for correcting the threshold voltage is performed in the first threshold correction period (E). Because only one operation is performed, a sufficiently long time period is not obtained. Consequently, the voltage written into the retaining capacitor 3C is Vx1, which does not reach the threshold voltage Vth for the driving transistor 3B.

An elapsing period (F) follows. Then, the second threshold voltage-correcting period (G) occurs in the next horizontal period (1H). At this time, the second operation for correcting the threshold voltage is performed. The voltage Vx2 written into the retaining capacitor 3C approaches Vth. Another elapsing period (H) follows. Then, the third threshold voltage-correcting period (I) occurs in the next one horizontal period (1H). The third operation for correcting the threshold voltage is performed. Consequently, the voltage written into the retaining capacitor 3C reaches the threshold voltage Vth for the driving transistor 3B.

In the latter half of the final one horizontal period, the potential at the video signal line DTL101 rises from the reference voltage Vo to the signal potential Vin. After a lapse of a period of J, the signal potential Vin of the video signal is written into the retaining capacitor 3C such that the potential Vin is added to Vth during a sampling period/mobility correction period (K). A voltage ΔV for correction of the mobility is subtracted from the voltage retained in the retaining capacitor 3C. Then, an emission period (L) follows. The light-emitting device emits light at a brightness corresponding to the signal voltage Vin. At this time, since the signal voltage Vin is adjusted by the voltage corresponding to the threshold voltage Vth and the voltage ΔV for correction of the mobility, the brightness of the emission from the light-emitting device 3D is affected neither by variations in the threshold voltage Vth for the driving transistor 3B nor by variations in the mobility μ. At the beginning of the emission period (L), a bootstrap operation is performed. The gate potential Vg and source potential Vs of the driving transistor 3B are increased while maintaining a constant gate/source voltage Vgs=Vin+Vth−ΔV of the driving transistor 3B.

In the embodiment shown in FIG. 4A, the operation for correcting the threshold voltage is repeated three times. The three operations for the corrections are carried out in the periods E, G, and I, respectively. These periods E, G, and I belong to the former halves of the horizontal periods (1H). In these periods, the signal line DTL101 is at the reference potential Vo. In the periods, the potential at the scanning line WSL101 is switched to a high level to turn on the sampling transistor 3A. As a result, the gate potential Vg of the driving transistor 3B becomes equal to the reference potential Vo. During this period, an operation for correcting the threshold voltage of the driving transistor 3B is performed. In the latter halves of the horizontal periods (1H), the signal potential is sampled for other rows of pixels. Accordingly, in the periods (F) and (H), the potential at the scanning line WSL101 is switched to a low level, turning off the sampling transistor 3A. These operations are repeated. The gate-source voltage Vgs of the driving transistor 3B soon reaches the threshold voltage Vth for the driving transistor 3B. The number of repetitions of the operation for correcting the threshold voltage is optimally set according to the pixel circuit configuration. Consequently, the operations for correcting the threshold voltage are performed reliably. Hence, good image quality can be obtained at all the gray levels from the lowest level (i.e., the black level) to the highest level (i.e., the white level).

Figure 4B:
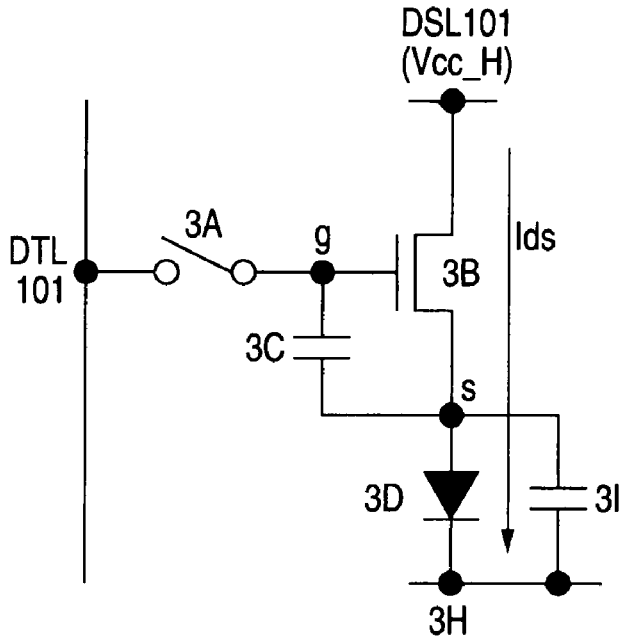
FIG. 4B is a circuit diagram illustrating the operation.

Referring still to FIGS. 4B-4L, the operation of the pixel 101 shown in FIG. 3B is described in detail. The figure numbers given to FIGS. 4B-4L correspond to periods (B)-(L), respectively, in the timing chart shown in FIG. 4A. To facilitate understanding, the capacitive component of the light-emitting device 3D is shown as a capacitive element 3I for the sake of convenience of illustration in FIGS. 4B-4L. First, as shown in FIG. 4B, in the emission period (B), the power supply line DSL101 is at a high potential of Vcc_H (first potential). The driving transistor 3B is supplying a driving current Ids to the light-emitting device 3D. As shown, the driving current Ids passes into the light-emitting device 3D from the power supply line DSL101 at the high potential of Vcc_H via the driving transistor 3B, and flows into a common grounding line 3H.

Figure 4C:
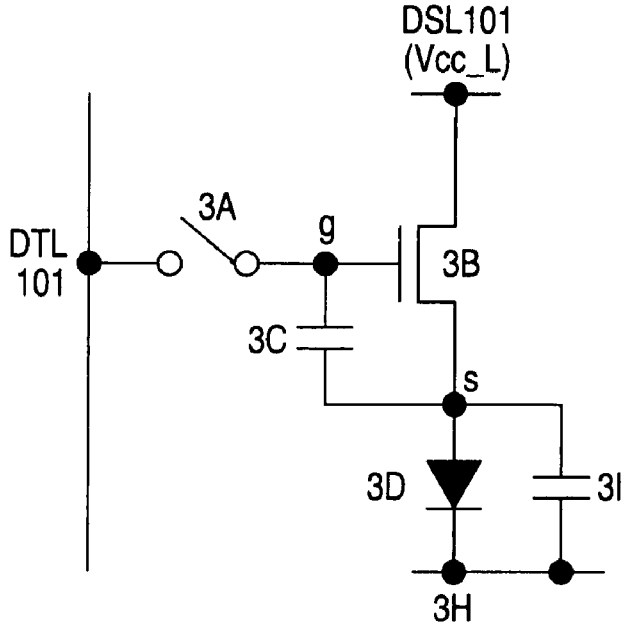
FIG. 4C is a circuit diagram illustrating the operation.

The period (C) follows. As shown in FIG. 4C, the power supply line DSL101 is switched from a high potential Vcc_H to a low potential Vcc_L. Thus, the power supply line DSL101 is discharged until the low potential Vcc_L is reached. Furthermore, the source potential Vs of the driving transistor 3B goes to a potential close to Vcc_L. Where the line capacitance of the power supply line DSL101 is large, it is better to switch the power supply line DSL101 from the high potential Vcc_H to the low potential Vcc_L at a relatively early timing. The effects of the line capacitance and other pixel parasitic capacitors can be eliminated by making the period (C) sufficiently long.

Figure 4D:
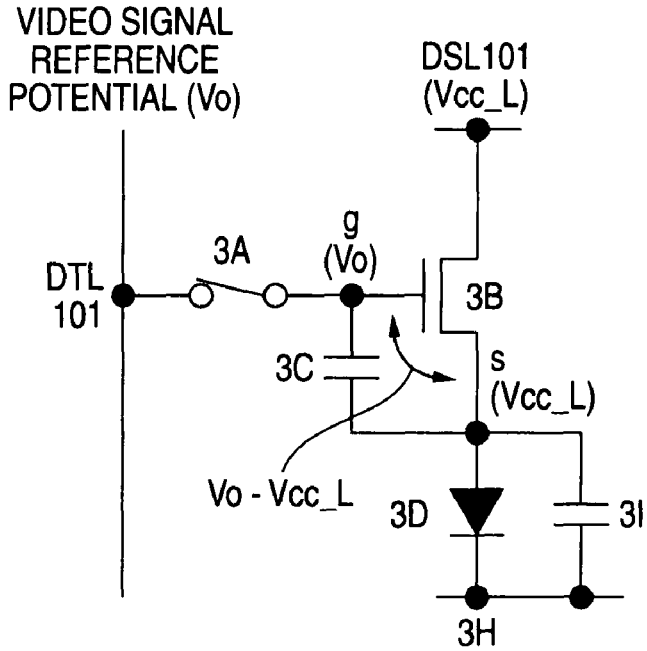
FIG. 4D is a circuit diagram illustrating the operation.

Then, the period (D) follows. As shown in FIG. 4D, the sampling transistor 3A is brought into conduction by switching the scanning line WSL101 from a low level to a high level. At this time, the video signal line DTL101 is at the reference potential Vo. Therefore, the gate potential Vg of the driving transistor 3B is made equal to the reference potential Vo at the video signal line DTL101 through the conducting sampling transistor 3A. The source potential Vs of the driving transistor 3B is quickly fixed at the low potential Vcc_L. As a result, the source potential Vs of the driving transistor 3B is reset to the potential Vcc_L that is sufficiently lower than the reference potential Vo at the video signal line DTL. In particular, the low potential Vcc_L (second potential) at the power supply line DSL101 is so set that the gate-source voltage Vgs (difference between the gate potential Vg and source potential Vs) of the driving transistor 3B becomes greater than the threshold voltage Vth for the driving transistor 3B.

Figure 4E:
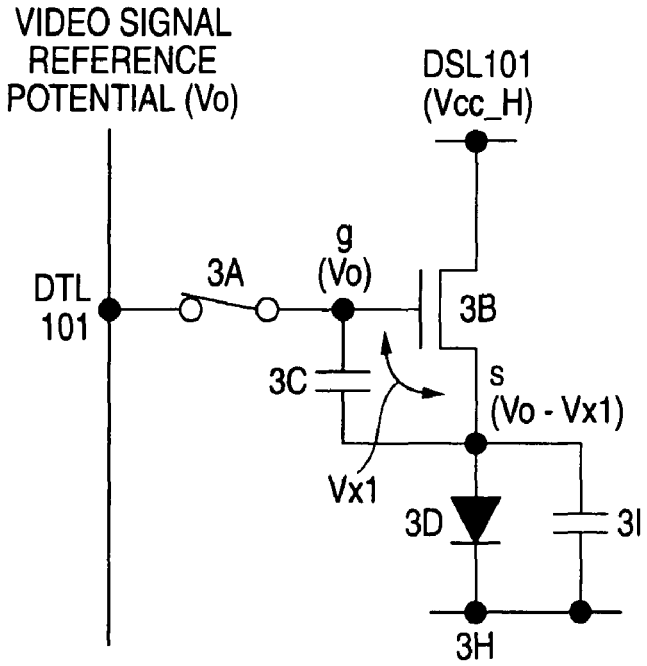
FIG. 4E is a circuit diagram illustrating the operation.

Then, the first period (E) for correction of the threshold value follows. As shown in FIG. 4E, the potential at the power supply line DSL101 goes from the low potential Vcc_L to the high potential Vcc_H. The source potential Vs of the driving transistor 3B begins to rise. This period (E) ends when the source potential Vs makes a transition from Vcc_L to Vx1. Therefore, Vx1 is written into the retaining capacitor 3C in the first period (E) for correction of the threshold value.

Figure 4F:
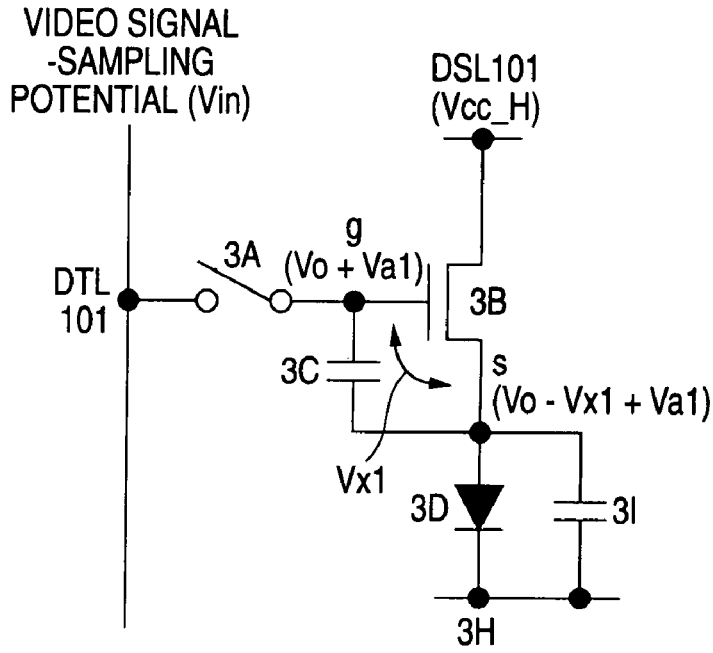
FIG. 4F is a circuit diagram illustrating the operation.

Subsequently, in the latter half (F) of this horizontal period (1H), the potential at the video signal line varies to the signal potential Vin while the potential at the scanning line WSL101 goes to a low level as shown in FIG. 4F. In this period (F), the signal potential Vin is sampled for the other rows of pixels. It is necessary that the sampling transistor 3A of the pixels be turned off.

Figure 4G:
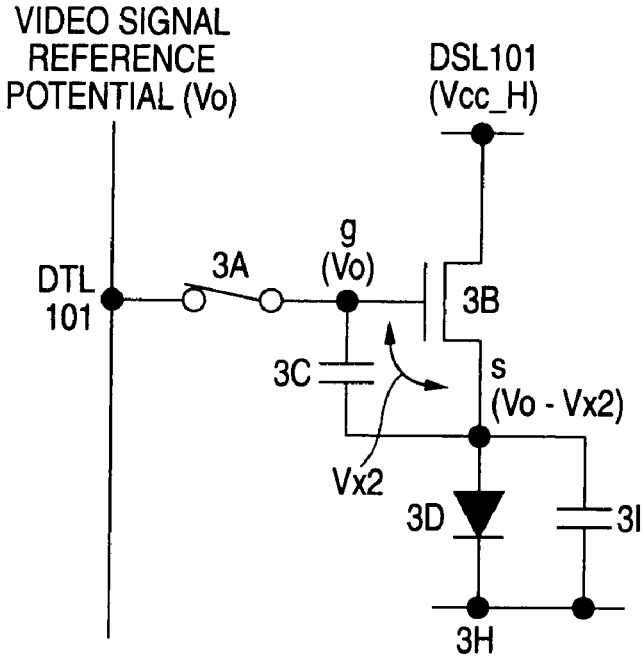
FIG. 4G is a circuit diagram illustrating the operation.
Figure 4H:
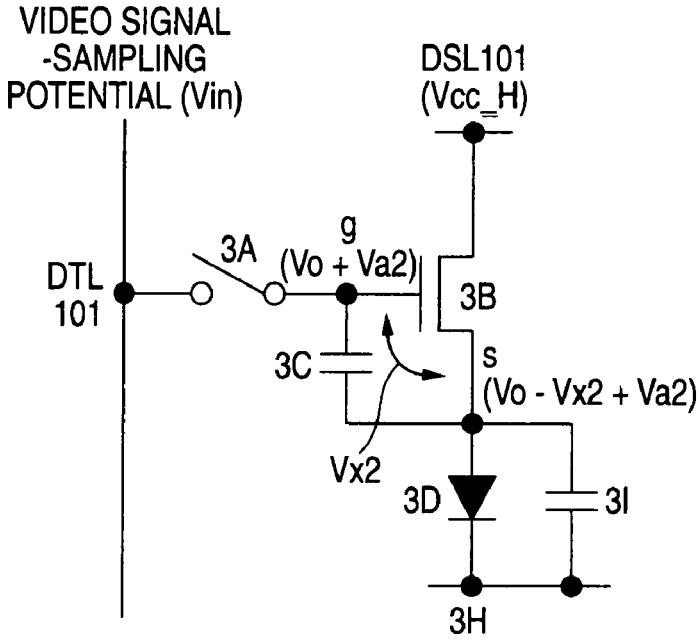
FIG. 4H is a circuit diagram illustrating the operation.

The former half of the next 1 horizontal period (1H) is another threshold value correction period (G). As shown in FIG. 4G, a second operation for correction of the threshold value is performed. In the same way as in the first operation, the video signal line DTL101 becomes the reference potential Vo, and a scanning line WSL101 goes to a high level. The sampling transistor 3A is turned on. Because of these operations, writing of the potential into the retaining capacitor 3C is made to progress. The potential reaches Vx2.

In the latter half (H) of this horizontal period (1H), in order to sample the signal potential for the other rows of pixels, the scanning line WSL101 of the rows is made to go low. The sampling transistor 3A is turned off.

Figure 4I:
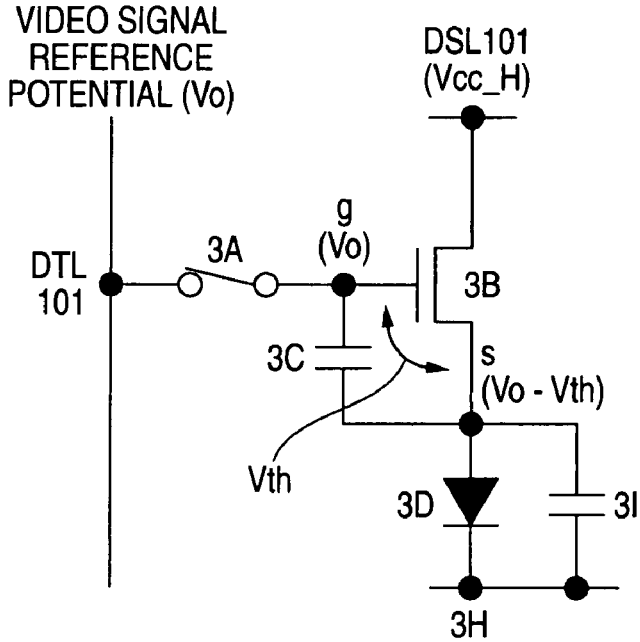
FIG. 4I is a circuit diagram illustrating the operation.

In the third period (I) for correction of the threshold value, the scanning line WSL101 is again switched to a high level, as shown in FIG. 4I, to turn on the sampling transistor 3A. The source potential Vs of the driving transistor 3B starts to rise. Just when the gate-source voltage Vgs of the driving transistor 3B reaches the threshold voltage Vth, the current is cut off. In this way, a voltage corresponding to the threshold voltage Vth for the driving transistor 3B is written into the retaining capacitor 3C. In all of the three periods (E), (G), and (I) for correction of the threshold value, the potential at the common grounding line 3H is so set that the light-emitting device 3D is cut off such that all the driving current flows through the retaining capacitor 3C but does not flow through the light-emitting device 3D.

Figure 4J:
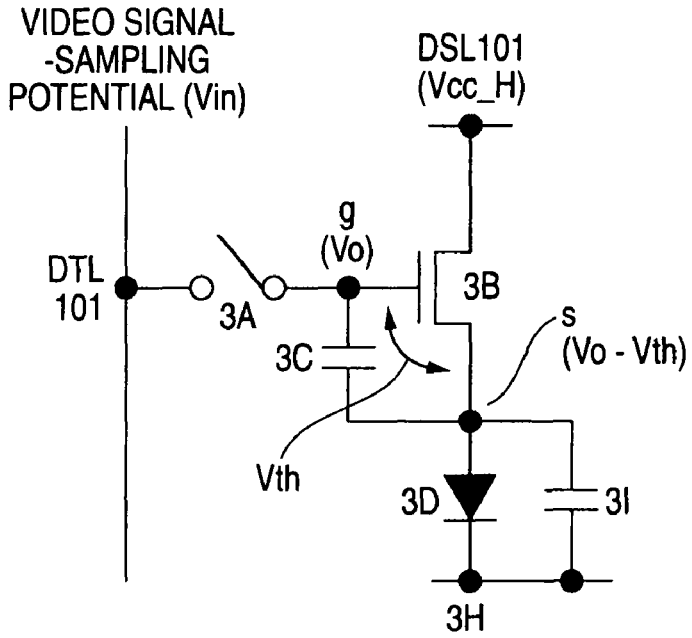
FIG. 4J is a circuit diagram illustrating the operation.

In the following period (J), the potential at the video signal line DTL101 goes to the sampling potential (signal potential) Vin from the reference potential Vo as shown in FIG. 4J. Thus, preparations for the next sampling operation and operation for correction of the mobility are completed.

Figure 4K:
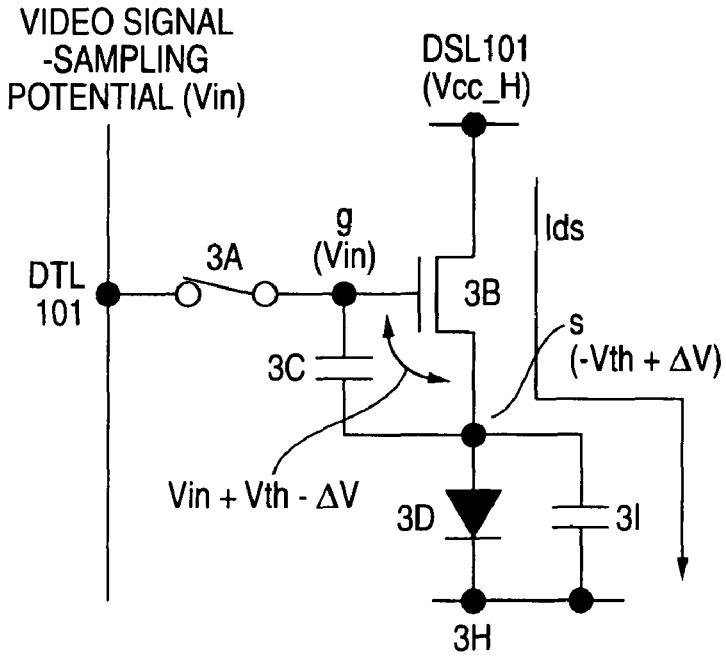
FIG. 4K is a circuit diagram illustrating the operation.

When the process enters the sampling period/mobility correction period (K), the potential at the scanning line WSL101 goes to the higher potential side, as shown in FIG. 4K. The sampling transistor 3A is turned on. Accordingly, the gate potential Vg of the driving transistor 3B becomes equal to the signal potential Vin. Since the light-emitting device 3D is in the cutoff state (high impedance state) at first, the drain-source current Ids of the driving transistor 3B flows into the light-emitting device capacitor 3I. The capacitor starts to be charged. Therefore, the source potential Vs of the driving transistor 3B starts to rise. The gate-source voltage Vgs of the driving transistor 3B soon reaches (Vin+Vth−ΔV). In this way, sampling of the signal potential Vin and adjustment of the amount of correction ΔV are performed at the same time. As the potential Vin is increased, the current Ids is increased, and the absolute value of ΔV also is increased. Accordingly, a mobility correction is made according to the level of the emission brightness. Where it is assumed that the potential Vin is constant, the absolute value of ΔV is increased with increasing the mobility μ of the driving transistor 3B. In other words, as the mobility μ is increased, the amount of negative feedback ΔV is increased. Consequently, variations in mobility μ among individual pixels can be eliminated.

Figure 4L:
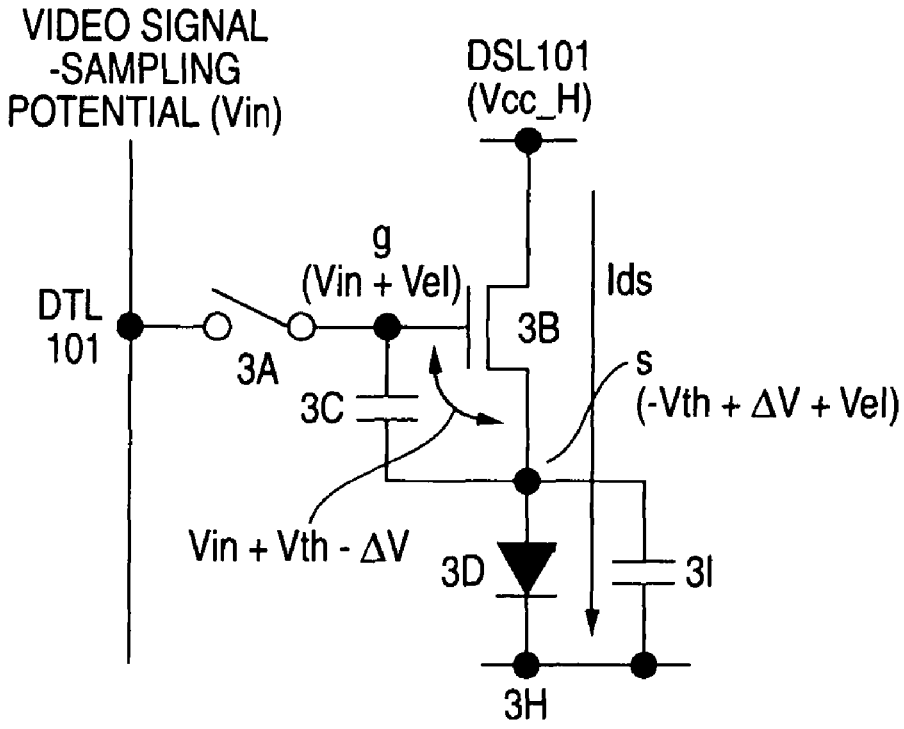
FIG. 4L is a circuit diagram illustrating the operation.

Finally, the process enters the emission period (L). As shown in FIG. 4L, the scanning line WSL101 makes a transition to the lower potential side, turning off the sampling transistor 3A. Consequently, the gate g of the driving transistor 3B is disconnected from the signal line DTL101. At the same time, the drain current Ids starts to flow through the light-emitting device 3D. Thus, the anode potential at the light-emitting device 3D rises by an amount of Vel according to the driving current Ids. The rise of the anode potential of the light-emitting device 3D is none other than an increase of the source potential Vs of the driving transistor 3B. When the source potential Vs of the driving transistor 3B rises, the gate potential Vg of the driving transistor 3B is increased responsively by the bootstrap operation of the retaining capacitor 3C. The amount of increase Vel of the gate potential Vg becomes equal to the amount of increase Vel of the source potential Vs. Therefore, during the emission period, the gate-source voltage Vgs of the driving transistor 3B is kept at a constant value of (Vin+Vth−ΔV).

Figure 5:
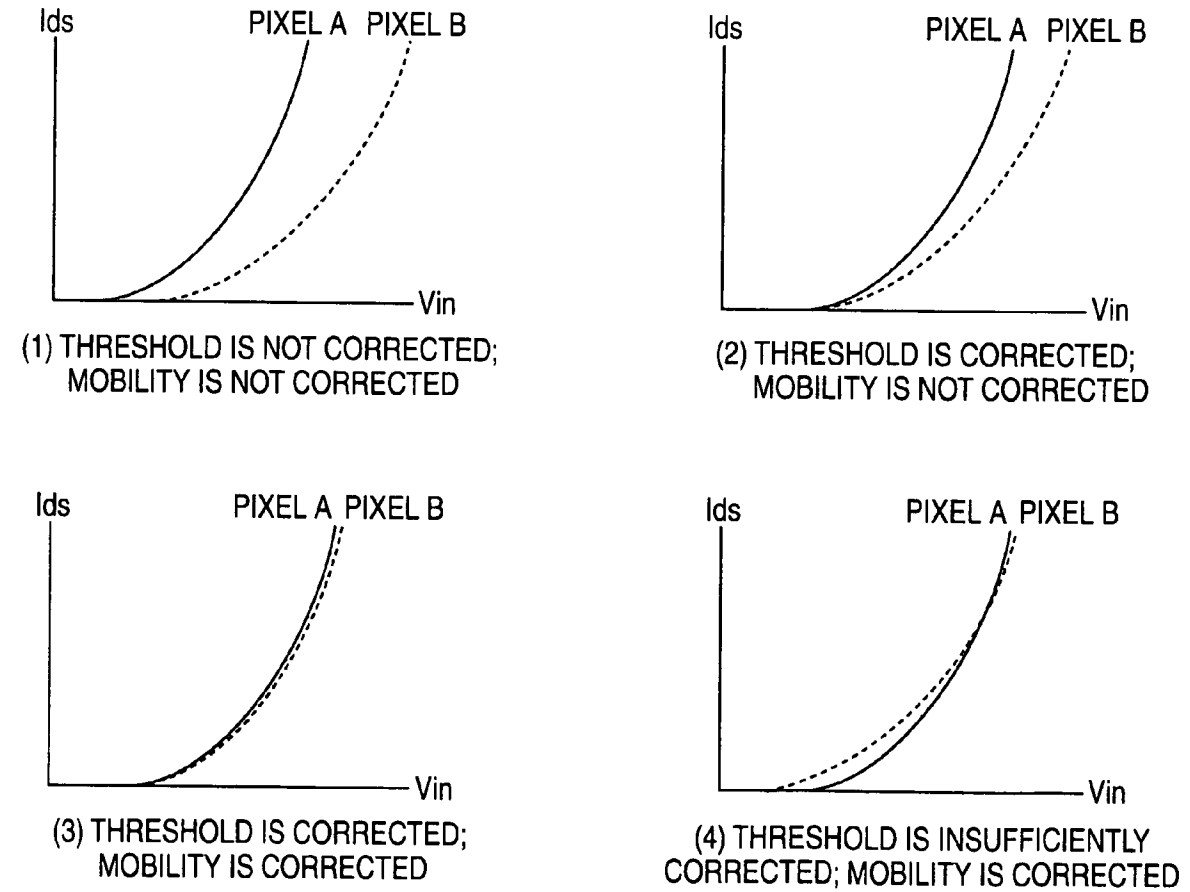
FIG. 5 shows graphs illustrating the operation of display device according to an embodiment of the invention.

As is obvious from the description provided so far, in a display device according to an embodiment of the present invention, each pixel has a threshold voltage-correcting function and a mobility-correcting function. FIG. 5 shows graphs representing the current-voltage characteristics of the driving transistor included in each pixel having such corrective functions. In each graph, the signal potential Vin is plotted on the horizontal axis, while the driving current Ids is plotted on the vertical axis. The Vin/Ids characteristics of different pixels A and B are graphed. At the pixel A, the threshold voltage Vth is relatively low and the mobility μ is relatively large. Conversely, at the pixel B, the threshold voltage Vth is relatively high but the mobility μ is relatively small.

Graph (1) shows a case where the correction of the threshold value and the correction of the mobility are not done. At this time, at the pixels A and B, neither the threshold voltage Vth nor the mobility μ is corrected. Therefore, the pixels are greatly different in Vin/Ids characteristics depending on variations in Vth and μ. Accordingly, if the same signal potential Vin is given, the driving current Ids becomes different. That is, the emission brightness becomes different. A good uniformity across the screen is not obtained.

Graph (2) shows a case where the threshold value is corrected but the mobility is not corrected. At this time, the difference in Vth between the pixels A and B is canceled out. However, the difference in the mobility μ appears intact. Therefore, in a region where Vin is high (i.e., where the brightness is high), the difference in the mobility μ appears conspicuously. Different levels of brightness appear even at the same gray level. More specifically, at the same gray level (at the same Vin), the pixel A having the larger mobility μ produces a higher level of brightness (higher level of driving current Ids). The pixel B having the smaller mobility μ produces a lower level of brightness.

Graph (3) shows a case where both the correction of the threshold value and the correction of the mobility have been carried out. This case corresponds to an embodiment of the present invention. Differences caused by variations in the threshold voltage Vth and the mobility μ have been completely corrected. As a result, the pixels A and B are coincident in Vin/Ids characteristics. Accordingly, at all the gray levels (Vin), both pixels are identical in level of brightness (Ids). The uniformity across the screen has been improved conspicuously.

Graph (4) shows a reference example where the mobility has been corrected but the threshold voltage has been corrected insufficiently. In other words, the operation for correcting the threshold voltage is performed only once rather than repeated plural times. At this time, the difference in the threshold voltage Vth is not removed, and so the pixels A and B differ in brightness (driving current Ids) at low gray levels. Consequently, where the threshold voltage is corrected insufficiently, the brightness is not uniform at low gray levels, impairing the image quality.

Figure 6A:
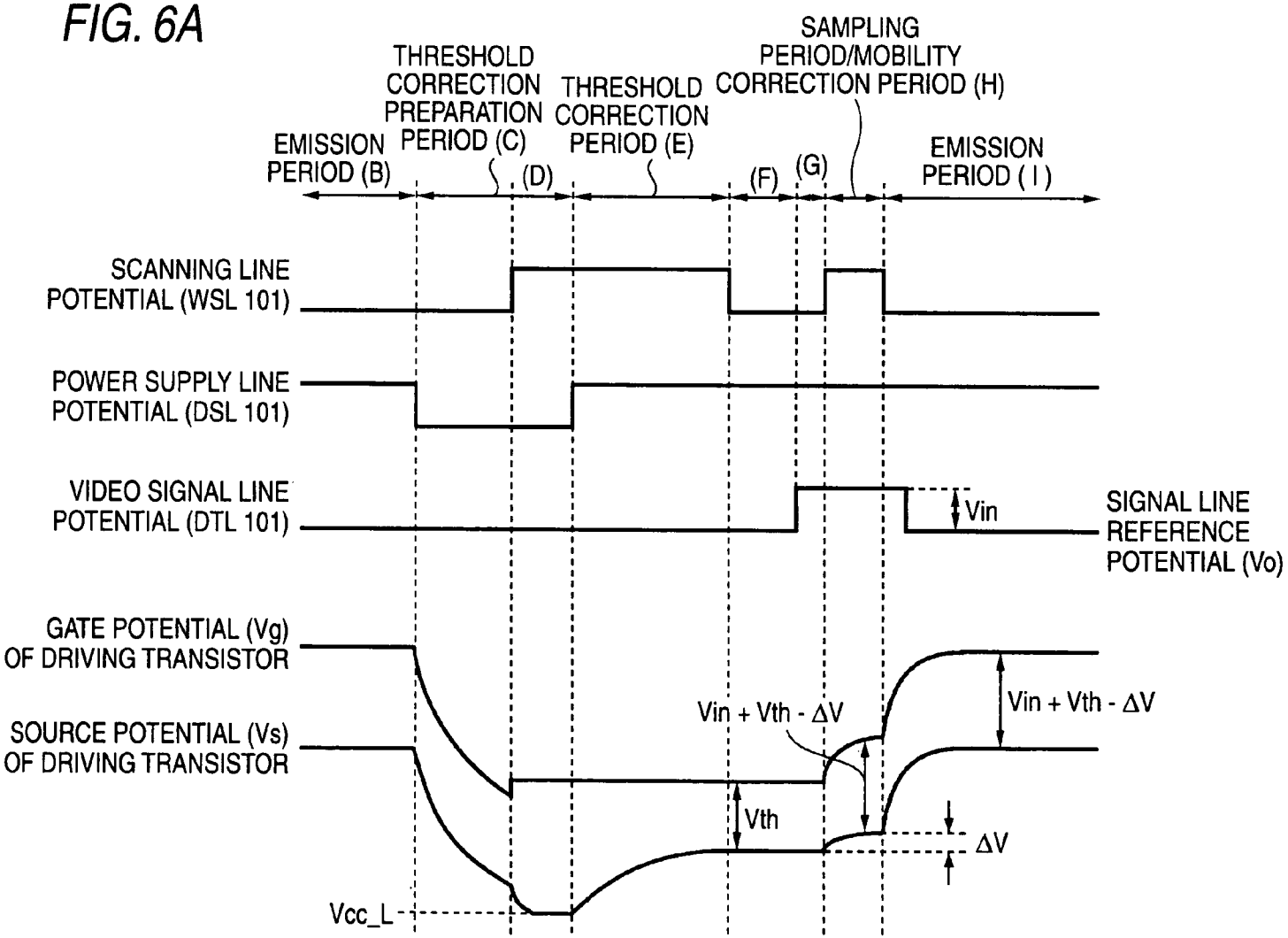
FIG. 6A is a timing chart showing a reference example of a method of driving a display device.

FIG. 6A is a timing chart showing a reference example of the method of driving the display device shown in FIG. 3B. The identical notation is used in both timing charts of FIGS. 3B and 4A to facilitate understanding. The timing chart of FIG. 4A illustrates a method of driving the display device according to one embodiment of the present invention. The difference with the method of driving the display device shown in FIG. 4A in accordance with one embodiment of the present invention is that only one operation for correcting the threshold voltage is performed in this reference example.

Figure 6B:
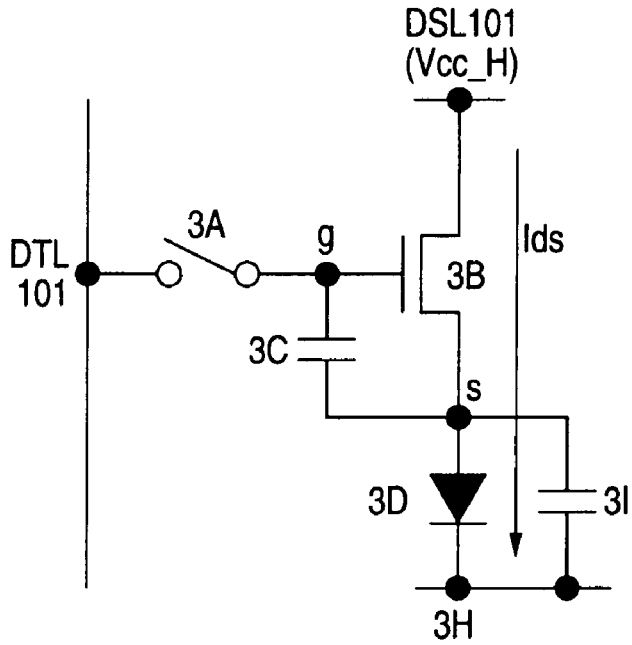
FIG. 6B is a circuit diagram illustrating the operation of the reference example.

Operations performed in the periods (B)-(I) in the timing chart shown in FIG. 6A are described briefly by referring still to FIGS. 6B-6I. First, as shown in FIG. 6B, in the emission period (B), the power supply line DSL101 is at the high potential Vcc_H (first potential). The driving transistor 3B is supplying the driving current Ids to the light-emitting device 3D. As shown, the driving current Ids passes from the power supply line DSL101 at the high potential Vcc_H into the light-emitting device 3D via the driving transistor 3B and flows into the common grounding line 3H.

Figure 6C:
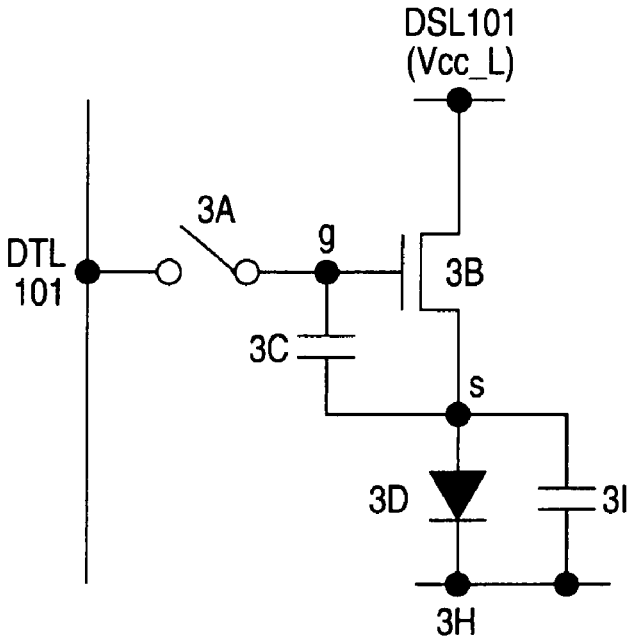
FIG. 6C is a circuit diagram illustrating the operation of the reference example.

Then, the process enters the period (C). As shown in FIG. 6C, the power supply line DSL101 is switched from the high potential Vcc_H to the low potential. Vcc_L. Thus, the power supply line DSL101 is discharged to the potential Vcc_L. Furthermore, the source potential Vs of the driving transistor 3B goes to a potential close to Vcc_L. Where the line capacitance of the power supply line DSL101 is large, it is better to switch the power supply line DSL101 from the high potential Vcc_H to the low potential Vcc_L at a relatively early timing. The effects of the line capacitor and other pixel parasitic capacitors can be eliminated by making the period (C) sufficiently long.

Figure 6D:
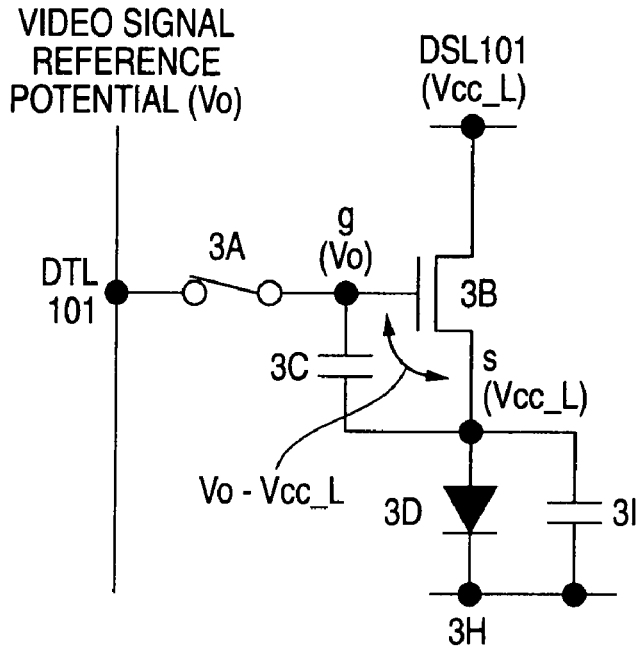
FIG. 6D is a circuit diagram illustrating the operation of the reference example.

Then, the process goes to the period (D). The sampling transistor 3A is brought into conduction by switching the scanning line WSL101 from a low level to a high level, as shown in FIG. 6D. At this time, the video signal line DTL101 is at the reference potential Vo. Therefore, the gate potential Vg of the driving transistor 3B is made equal to the reference potential Vo of the video signal line DTL101 through the conducting sampling transistor 3A. At the same time, the source potential Vs of the driving transistor 3B is quickly fixed at the low potential Vcc_L. Because of the operations described so far, the source potential Vs of the driving transistor 3B is reset to the initial potential, i.e., the potential Vcc_L that is sufficiently lower than the reference potential Vo at the video signal line DTL. In particular, the low potential Vcc_L (second potential) at the power supply line DSL101 is so set that the gate-source voltage Vgs (difference between the gate potential Vg and source potential Vs) of the driving transistor 3B becomes greater than the threshold voltage Vth for the driving transistor 3B.

Figure 6E:
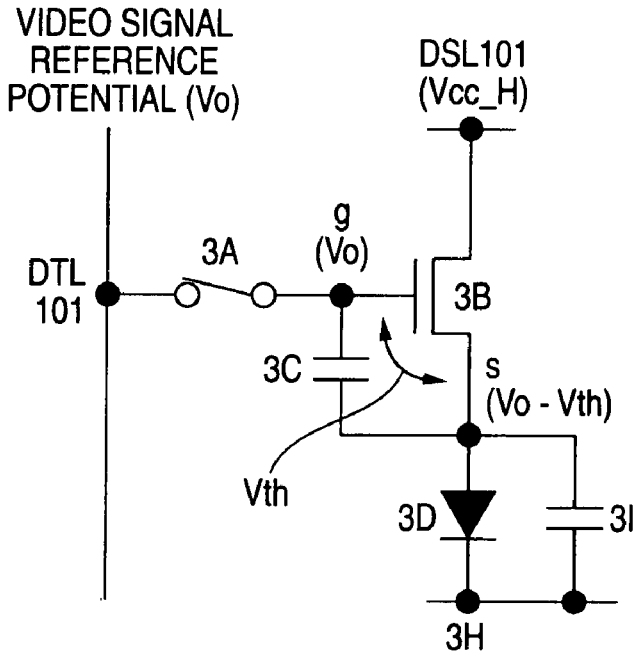
FIG. 6E is a circuit diagram illustrating the operation of the reference example.

Then, the process goes to the threshold value correction period (E). As shown in FIG. 6E, the power supply line DSL101 makes a transition from the low potential Vcc_L to the high potential Vcc_H. The source potential Vs of the driving transistor 3B begins to rise. The gate-source voltage Vgs of the driving transistor 3B soon reaches the threshold voltage Vth. At this time, the current is cut off. In this way, a voltage corresponding to the threshold voltage Vth for the driving transistor 3B is written into the retaining capacitor 3C. This is the operation for correcting the threshold voltage. The potential at the common grounding line 3H is so set that the light-emitting device 3D is cut off such that all the current flows through the retaining capacitor 3C but does not flow through the light-emitting device 3D. In practice, however, the single operation for correcting the threshold voltage may not provide a sufficient time. That is, the single operation may not make it possible to write a voltage corresponding to the threshold voltage Vth for the driving transistor 3B completely into the retaining capacitor 3C.

Figure 6F:
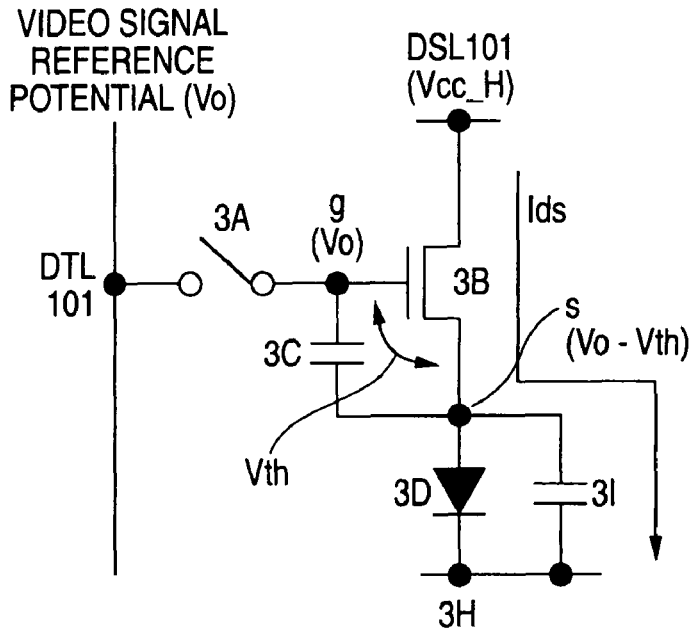
FIG. 6F is a circuit diagram illustrating the operation of the reference example.

The process goes to the period (F). As shown in FIG. 6F, the potential at the scanning line WSL101 makes a transition to the lower potential side. The sampling transistor 3A is once turned off. At this time, the gate g of the driving transistor 3B is floated. Because the gate-source voltage Vgs is equal to the threshold voltage Vth for the driving transistor 3B, the transistor is cut off. The drain current Ids does not flow.

Figure 6G:
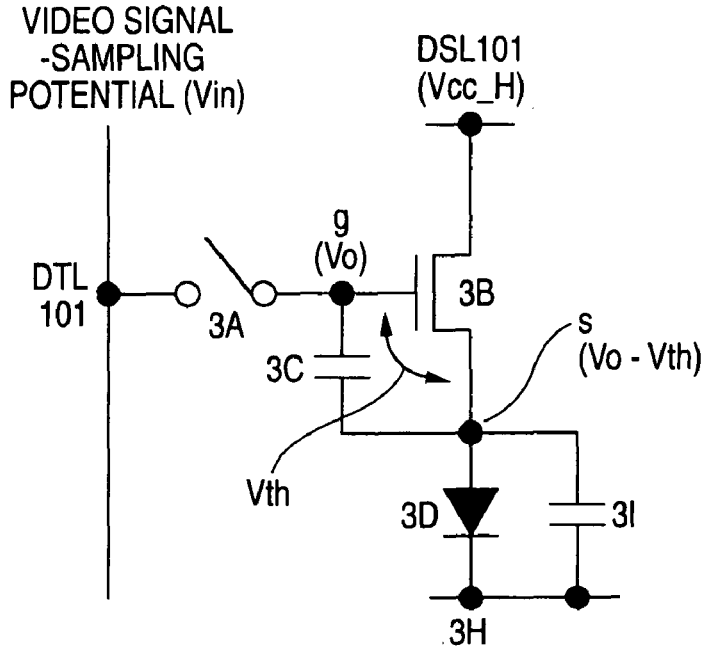
FIG. 6G is a circuit diagram illustrating the operation of the reference example.

Then, the process goes to the period (G). As shown in FIG. 6G, the potential at the video signal line DTL101 makes a transition from the reference potential Vo to the sampling potential (signal potential) Vin. In this way, preparations for the next sampling operation and for the operation for correction of the mobility are completed.

Figure 6H:
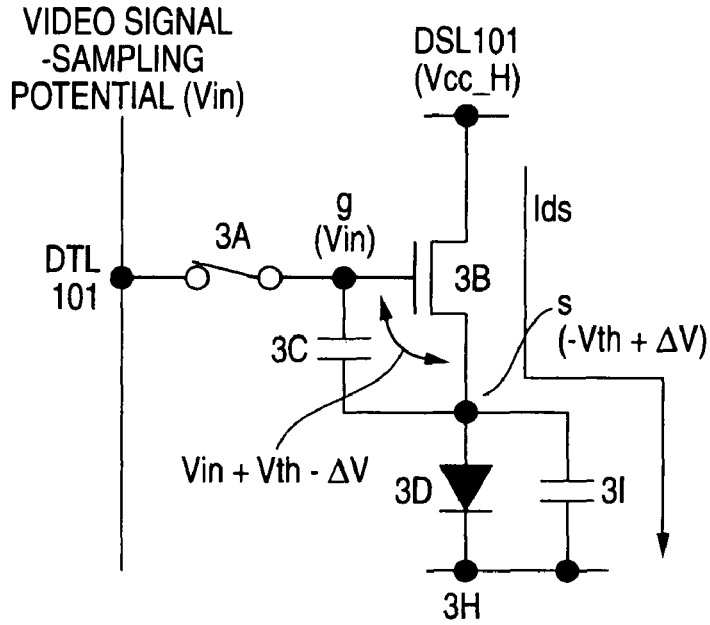
FIG. 6H is a circuit diagram illustrating the operation of the reference example.

When the process enters the sampling period/mobility correction period (H), the potential at the scanning line WSL101 makes a transition to the higher potential side as shown in FIG. 6H. The sampling transistor 3A is turned on. Accordingly, the gate potential Vg of the driving transistor 3*b* becomes equal to the signal potential Vin. Since the light-emitting device 3D is in the cutoff state (high impedance state) at first, the drain-source current Ids of the driving transistor 3B flows into the light-emitting capacitor 3I. The capacitor starts to be charged. Therefore, the source potential Vs of the driving transistor 3B starts to rise. The gate-source voltage Vgs of the driving transistor 3B soon reaches (Vin+Vth−ΔV). In this way, sampling of the signal potential Vin and adjusting the amount of correction ΔV are performed at the same time. As Vin is increased, Ids is increased, and the absolute value of ΔV also is increased. Accordingly, a mobility correction is made according to the level of the emission brightness. Where it is assumed that Vin is constant, the absolute value of ΔV is increased with increasing the mobility μ of the driving transistor 3B. In other words, as the mobility μ is increased, the amount of negative feedback ΔV is increased. Consequently, variations in mobility μ among the individual pixels can be removed.

Figure 6I:
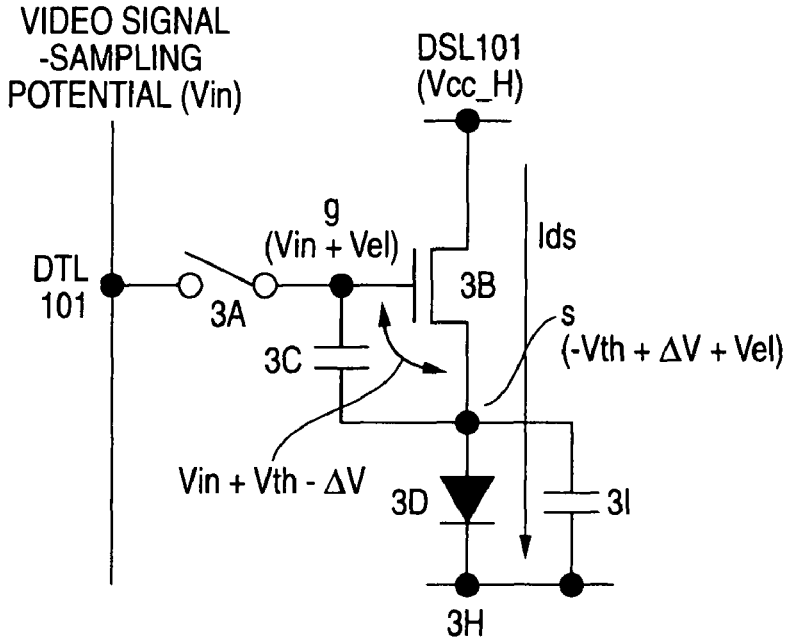
FIG. 6I is a circuit diagram illustrating the operation of the reference example.

Finally, the process goes to the emission period (I). As shown in FIG. 6I, the scanning line WSL101 make a transition to the lower potential side. The sampling transistor 3A is turned off. Consequently, the gate g of the driving transistor 3B is disconnected from the signal line DTL101. At the same time, the drain current Ids starts to flow through the light-emitting device 3D. Consequently, the anode potential of the light-emitting device 3D rises by an amount Vel in response to the driving current Ids. The increase in the anode potential of the light-emitting device 3D is none other than an increase in the source potential Vs of the driving transistor 3B. When the source potential Vs of the driving transistor 3B rises, the gate potential Vg of the driving transistor 3B is increased responsively by the bootstrap operation of the retaining capacitor 3C. The amount of increase Vel of the gate potential Vg becomes equal to the amount of increase Vel of the source potential Vs. Therefore, during the emission period, the gate-source voltage Vgs of the driving transistor 3B is kept at a constant value of (Vin+Vth−ΔV).

Finally, for the sake of references, the operation for correcting the threshold voltage, the operation for correcting the mobility, and the bootstrap operation, all performed in a display device according to an embodiment of the present invention, are described in detail.

Figure 7:
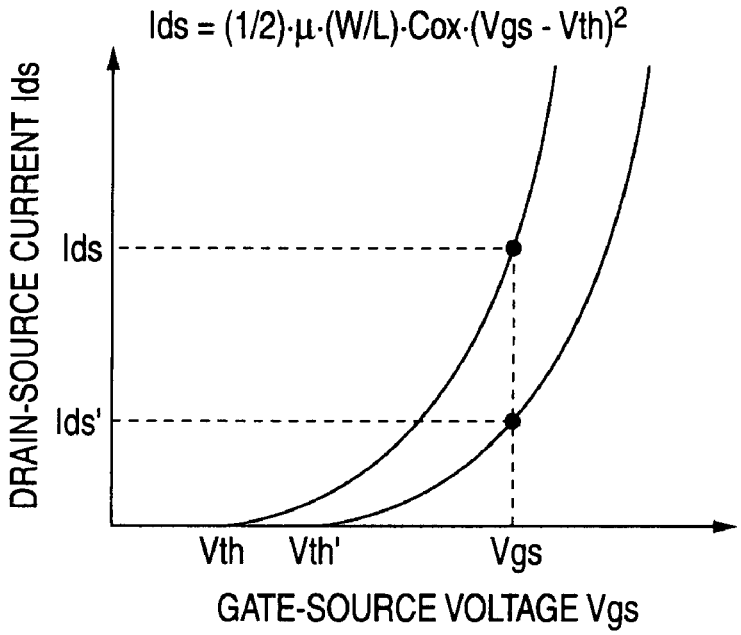
FIG. 7 is a graph showing the current-voltage characteristics of a driving transistor.

FIG. 7 is a graph showing the current-voltage characteristics of the driving transistor. Especially, when the driving transistor is operating in the saturation region, the drain-source current Ids is given by $$Ids=(1/2)\cdot\mu\cdot(W/L)\cdot Cox\cdot(Vgs-Vth)2$$

where μ indicates the mobility, W indicates the gate width, L indicates the gate length, and Cox indicates the gate oxide film capacitance per unit area. As is obvious from this equation indicating the transistor characteristics, when the threshold voltage Vth varies, the drain-source current Ids varies even if the voltage Vgs is constant. At each pixel according to an embodiment of the present invention, the gate-source voltage Vgs during emission is given by (Vin+Vth−ΔV), as described previously. When this is substituted into the above equation for the transistor characteristics, the drain-source current Ids is given by $$Ids=(1/2)\cdot\mu\cdot(W/L)\cdot Cox\cdot(Vin-\Delta V)2$$

Therefore, the current Ids does not depend on the threshold voltage Vth. As a result, if the threshold voltage Vth varies due to the manufacturing process, the drain-source current Ids does not vary. Furthermore, the emission brightness of the organic electroluminescent device does not vary.

Where no countermeasures are taken, the driving current corresponding to the Vgs when the threshold voltage is Vth is ids, as shown in FIG. 7. However, when the threshold voltage is Vth', the driving current corresponding to the same gate voltage Vgs assumes a value of Ids' different from Ids.

Figure 8A:
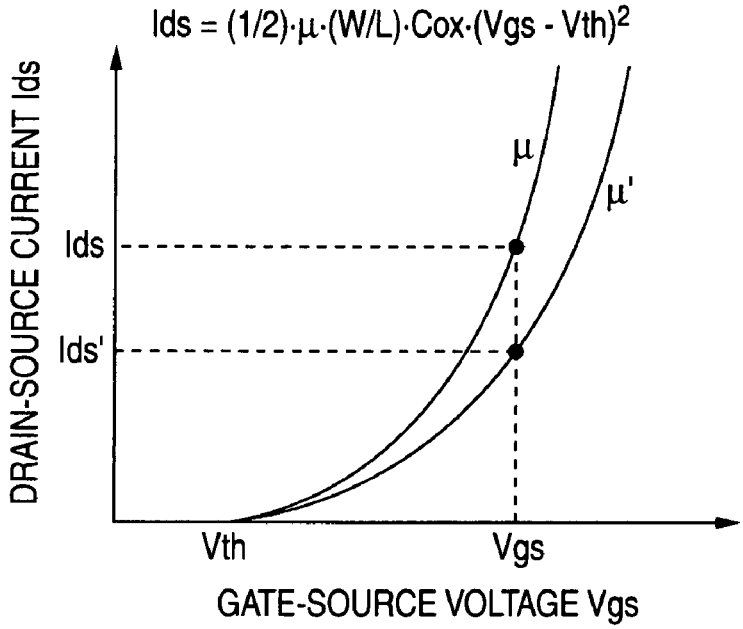
FIG. 8A is a graph showing the current-voltage characteristics of the driving transistor.

Similarly, FIG. 8A is a graph showing the current-voltage characteristics of driving transistors. The characteristic curves of two driving transistors having mobilities of μ and μ', respectively, are shown. As can be seen from the graph, the drain-source currents of the two transistors having the different values of mobility μ and μ', respectively, are Ids and Ids', respectively. That is, the transistors differ in drain-source current if they have the same value of Vgs.

Figure 8B:
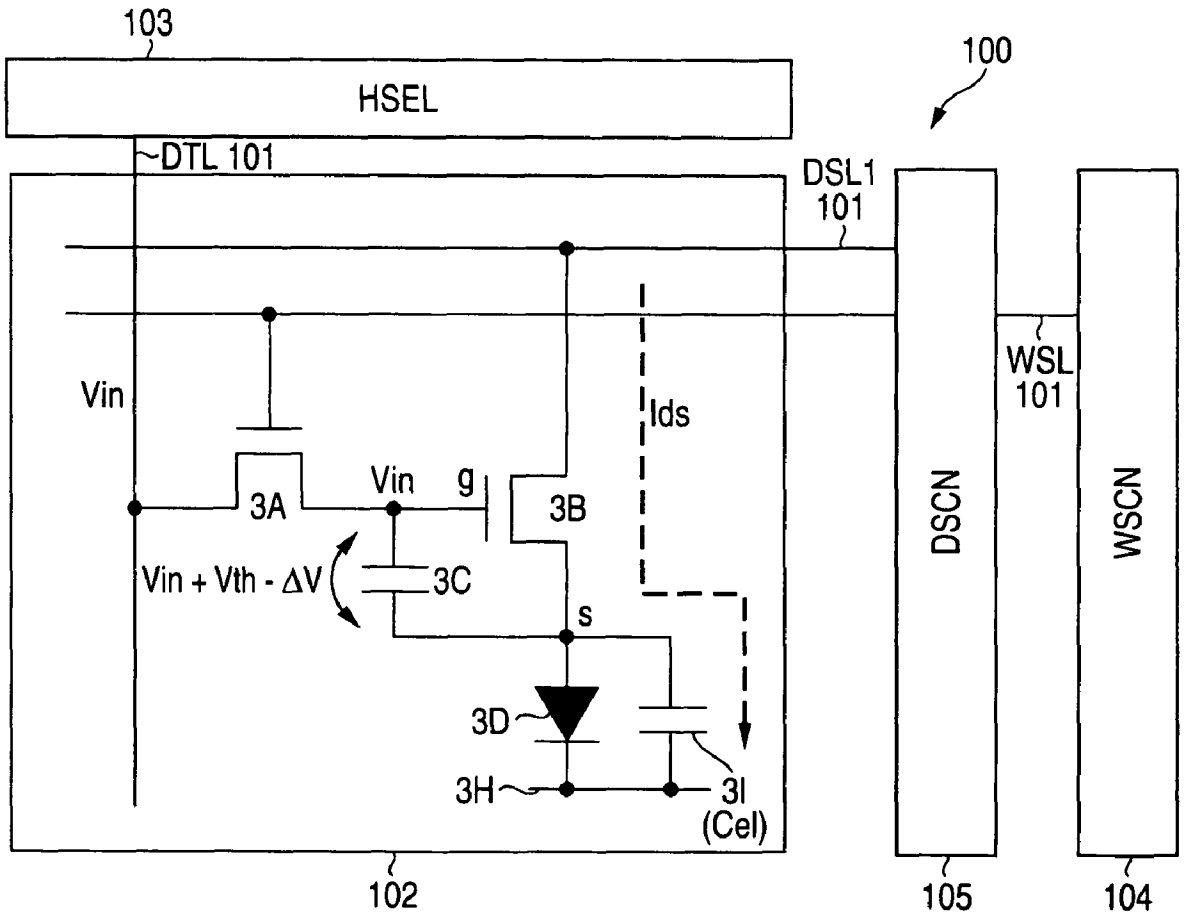
FIG. 8B is a circuit diagram illustrating the operation of a display device according to an embodiment of the present invention.

FIG. 8B illustrates the operation of a pixel when the video signal potential is sampled and when the mobility is corrected. To facilitate understanding, a parasitic capacitor 3I of a light-emitting device 3D also is shown. When the video signal potential is sampled, the sampling transistor 3A is conducting (ON), and so the gate potential Vg of the driving transistor 3B is the video signal potential Vin. The gate-source voltage Vgs of the driving transistor 3B is (Vin+Vth). At this time, the driving transistor 3B is conducting (ON). The light-emitting device 3D is cut off. Therefore, the drain-source current Ids flows into the light-emitting device capacitor 3I. If the drain-source current Ids flows into the light-emitting device capacitor 3I, the capacitor 3I starts to be electrically charged. The anode potential of the light-emitting device 3D (therefore, the source potential Vs of the driving transistor 3B) starts to rise. When the source potential Vs of the driving transistor 3B rises by ΔV, the gate-source voltage Vgs of the driving transistor 3B decreases by ΔV. This is an operation for correcting the mobility by making use of negative feedback. The amount of decrease ΔV of the gate-source voltage Vgs is determined by $$\Delta V=Ids\cdot Cel/t$$

where ΔV is a parameter for correcting the mobility, Cel indicates the value of the capacitance of the light-emitting device capacitor 3I, and t indicates the period in which the mobility is corrected.

Figure 8C:
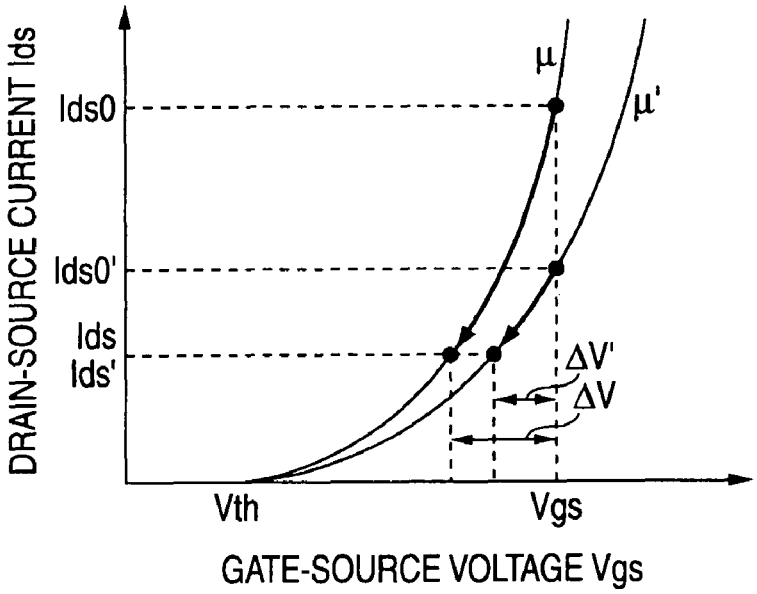
FIG. 8C is a graph of the current-voltage characteristics illustrating the operation.

FIG. 8C is a graph illustrating operating points of the driving transistor 3B when the mobility is corrected. Where different values of mobility μ and μ' are produced due to manufacturing process variations, optimum corrective parameters ΔV and ΔV' are determined by making the aforementioned mobility correction. The drain-source currents Ids and Ids' of the driving transistor 3B are determined. If the mobility correction is not made, and if there are different values of mobility μ and μ' for the gate-source voltage Vgs, the drain-source current produces different values of Ids0 and Ids0' accordingly. To cope with this, the values of the drain-source current are brought to the same level of Ids and Ids' by applying appropriate corrections ΔV and ΔV' to the mobilities μ and μ', respectively. As can be seen from the graph of FIG. 8C, a negative feedback is applied to increase the amount of correction ΔV when the mobility μ is large and to reduce the amount of correction ΔV' when the mobility μ' is small.

Figure 9A:
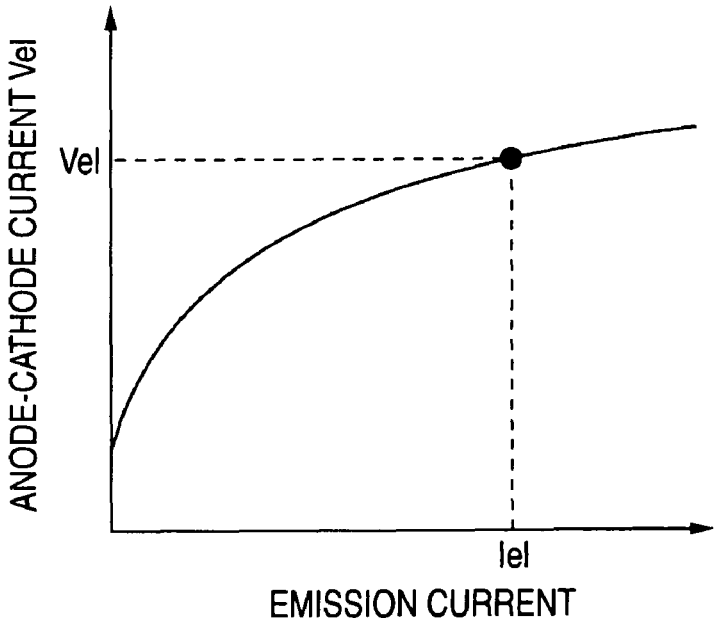
FIG. 9A is a graph showing the current-voltage characteristics of a light-emitting device.

FIG. 9A is a graph showing the current-voltage characteristics of the light-emitting device 3D made of an organic electroluminescent device. When current Ie1 flows through the light-emitting device 3D, the anode-cathode voltage Ve1 is uniquely determined. During the emission period, the potential at the scanning line WSL101 makes a transition to the lower potential side. When the sampling transistor 3A is turned off, the potential at the anode of the light-emitting device 3D rises by an amount equal to the anode-cathode voltage Ve1 determined by the drain-source current Ids of the driving transistor 3B.

Figure 9B:
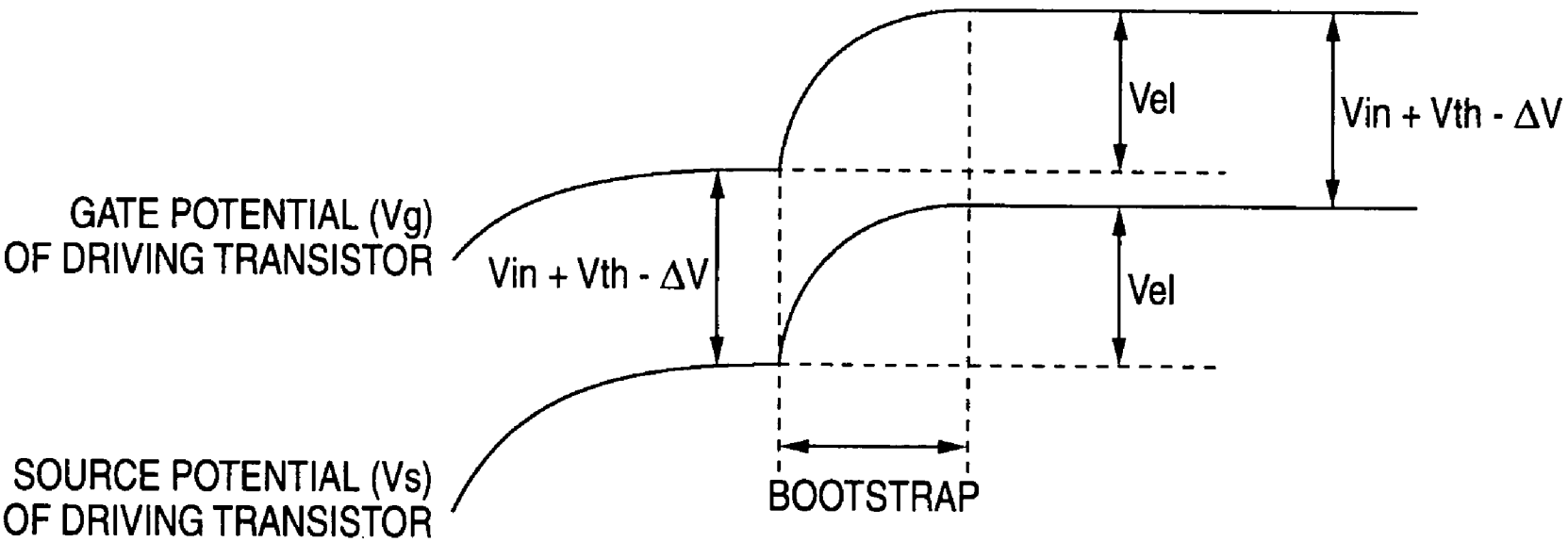
FIG. 9B is a waveform diagram illustrating the bootstrap operation of a driving transistor.

FIG. 9B is a graph showing variations in the gate potential Vg and in the source potential Vs of the driving transistor 3B when the anode potential of the light-emitting device 3D rises. When the amount of increase of the potential at the anode of the light-emitting device 3D is Ve1, the potential at the source of the driving transistor 3B also rises by Ve1. The potential at the gate of the driving transistor 3B is increased by Ve1 by a bootstrap operation of the retaining capacitor 3C. Therefore, the gate-source voltage, $Vgs=Vin+Vth-\Delta V$, of the driving transistor 3B retained before the bootstrap operation is maintained intact after the bootstrap. Furthermore, if the anode potential of the light-emitting device 3D varies due to its timewise variations, the gate-source voltage of the driving transistor 3B is kept at a constant value of $(Vin+Vth-\Delta V)$ at all times.

Figure 9C:
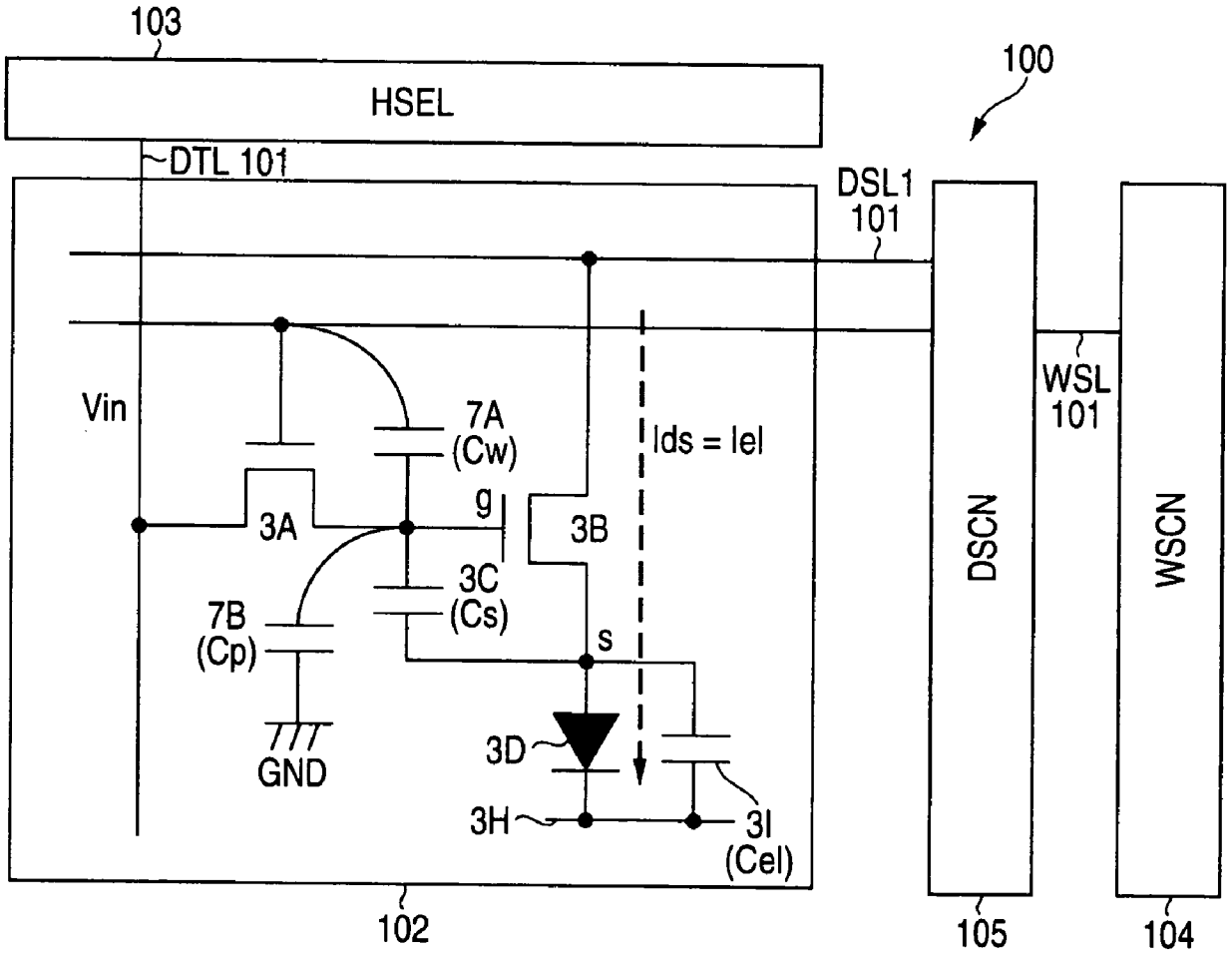
FIG. 9C is a circuit diagram illustrating the operation of a display device according to an embodiment of the invention.

FIG. 9C is a circuit diagram of the pixel structure shown in FIG. 3B and built according to an embodiment of the invention, the pixel structure having parasitic capacitors 7A and 7B added thereto. The parasitic capacitors 7A and 7B are parasitic on the gate g of the driving transistor 3B. It is assumed that the retaining capacitor has a capacitance Cs and that the parasitic capacitors 7A and 7B have capacitances Cw and Cp, respectively. The aforementioned bootstrapping capability is given by $Cs/(Cs+Cw+Cp)$. It can be said that the boostrapping capability is enhanced as the value is brought closer to 1. That is, the capability in making a correction for timewise degradation of the light-emitting device 3D is enhanced. In one embodiment of the present invention, the number of devices connected with the gate g of the driving transistor 3B is suppressed to a minimum. Cp can be almost neglected. Accordingly, the bootstrapping capability is given by $Cs/(Cs+Cw)$. It follows that the capability is infinitely close to 1. This indicates that the capability in correcting timewise degradation of the light-emitting device 3D is high.

Figure 10:
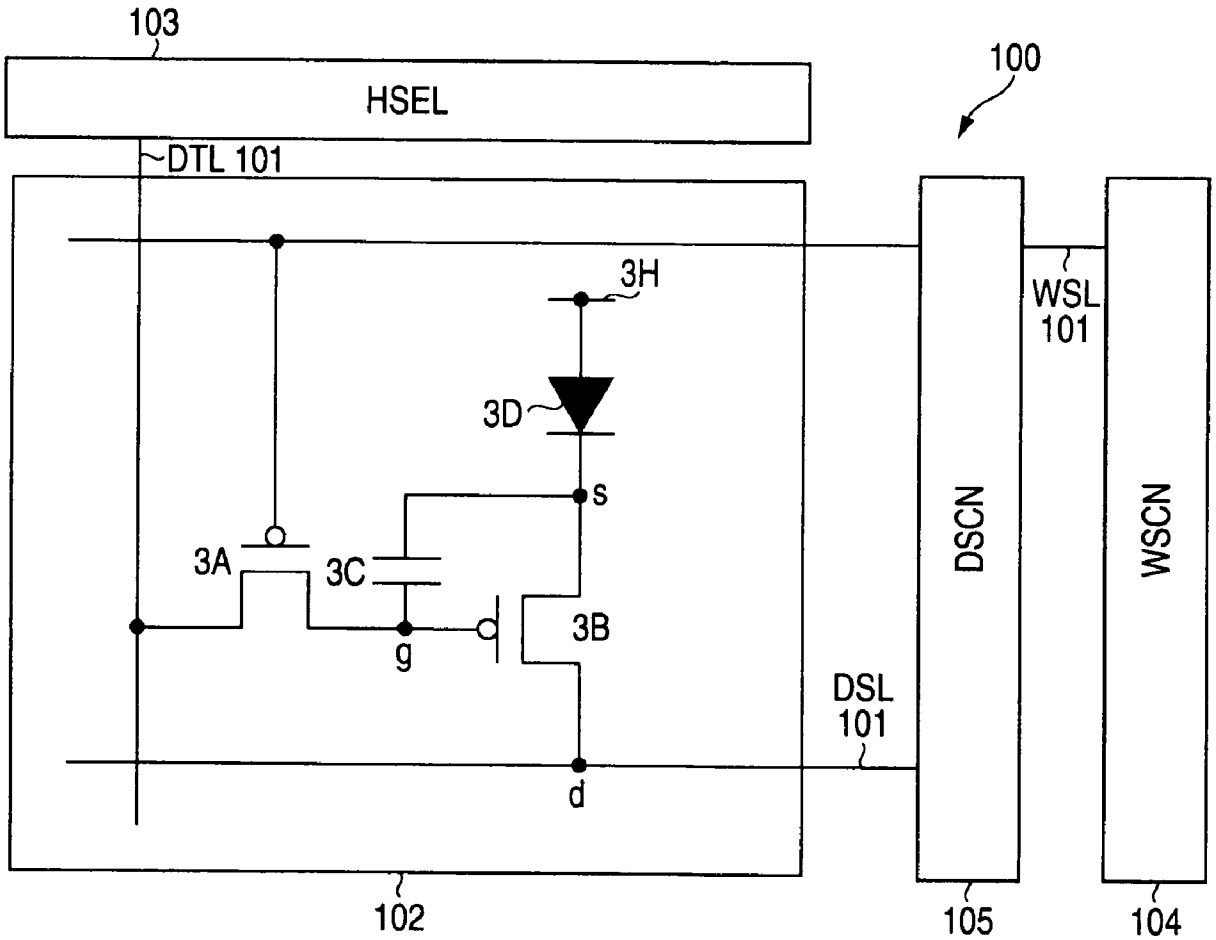
FIG. 10 is a circuit diagram showing another example of a display device according to an embodiment of the invention.

FIG. 10 is a schematic circuit diagram of other example of a display device according to an embodiment of the present invention. To facilitate understanding, like components are indicated by like reference numerals in both FIGS. 3B and 10, it being noted that FIG. 3B shows the previous example. The difference is that in the example shown in FIG. 3B, a pixel circuit is built using N-channel transistors, while in the example shown in FIG. 10, a pixel circuit is built using P-channel transistors. The pixel circuit shown in FIG. 10 can perform the operation for correction of the threshold voltage, the operation for correction of the mobility, and the bootstrap operation in exactly the same way as the pixel circuit shown in FIG. 3B.

Figure 11:
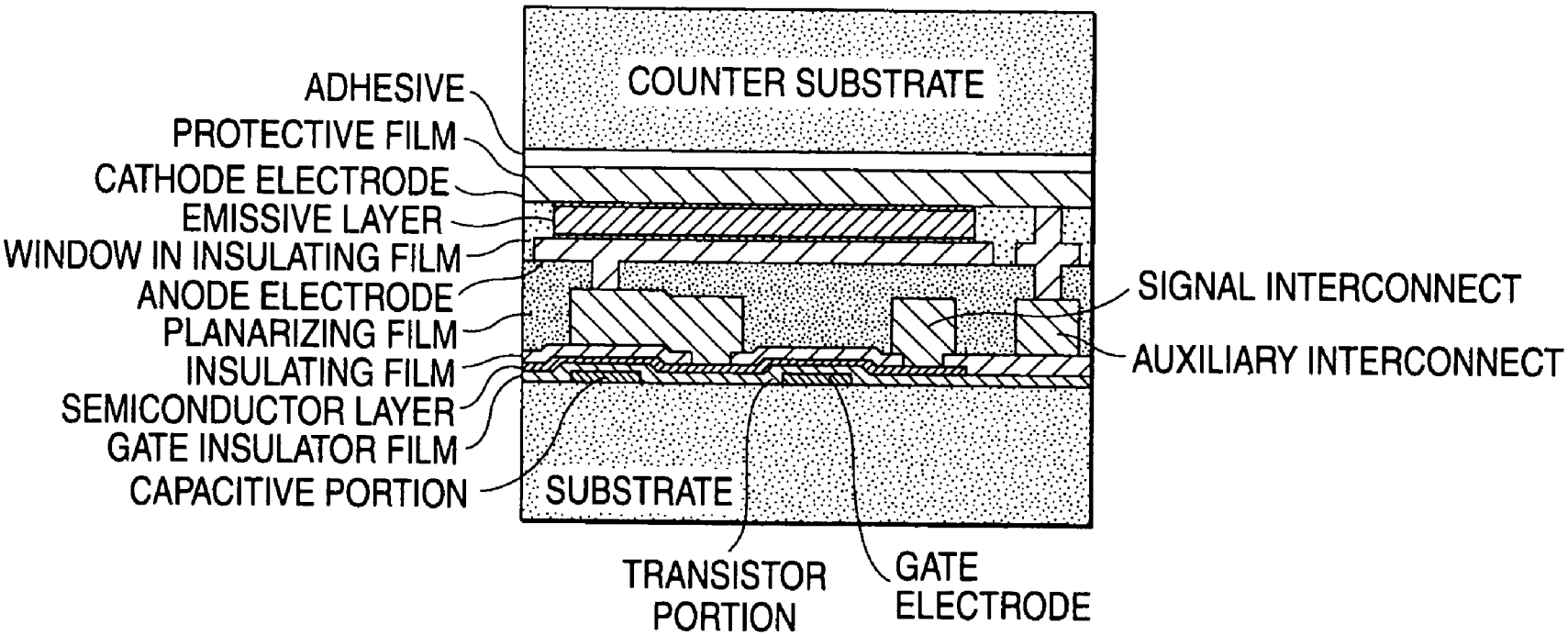
FIG. 11 is a cross-sectional view showing the structure of a display device according to an embodiment of the invention.

A display device according to an embodiment of the present invention has a thin-film device structure, as shown in FIG. 11, which shows a schematic cross-sectional structure of one of the pixels formed on an insulating substrate. As shown, the pixel includes transistors having plural TFTs (in the figure, only one TFT is shown), a capacitor portion such as a retaining capacitor, and a light-emitting portion such as an organic electroluminescent device. The transistors and the capacitor portion are fabricated on a substrate by a TFT fabrication process. The light-emitting portion, such as an organic electroluminescent device, is laminated on them. A transparent counter substrate is bonded to the light-emitting portion via an adhesive, thus forming a flat panel.

Figure 12:
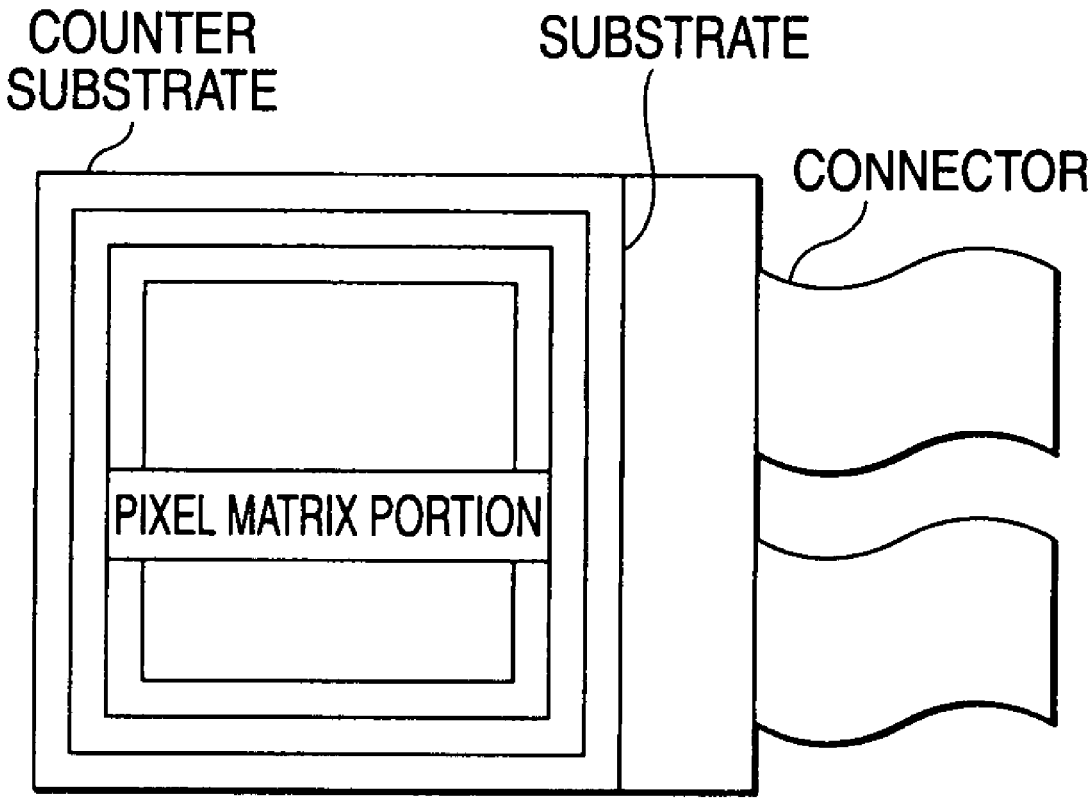
FIG. 12 is a plan view of a modular structure of a display device according to an embodiment of the invention.

A display device according to an embodiment of the present invention can assume a flat modular form as shown in FIG. 12. For example, a pixel array portion is formed on an insulating substrate. In the pixel array portion, multiple pixels including organic electroluminescent devices, thin-film transistors, and thin-film capacitors are arranged in a matrix. An adhesive is disposed around the pixel array portion (pixel matrix portion). A counter substrate made of glass is bonded, thus forming a display module. If necessary, color filters, a protective film, an optical shielding film, and so on may be formed on the transparent counter substrate. For example, a flexible printed circuit (FPC) may be mounted to the display module as a connector for inputting and outputting signals to the pixel array portion from the outside.

The display devices described so far and built according to embodiments of the present invention have the forms of a flat panel. These can be utilized as display devices which are used in various electronic devices (such as a digital camera, a notebook personal computer, a cell phone, and a video camera) in all fields and which display video signals entered into the electronic devices or video signals created within the electronic devices as visible images or pictures. Examples of the electronic devices utilizing such display devices are shown below.

Figure 13:
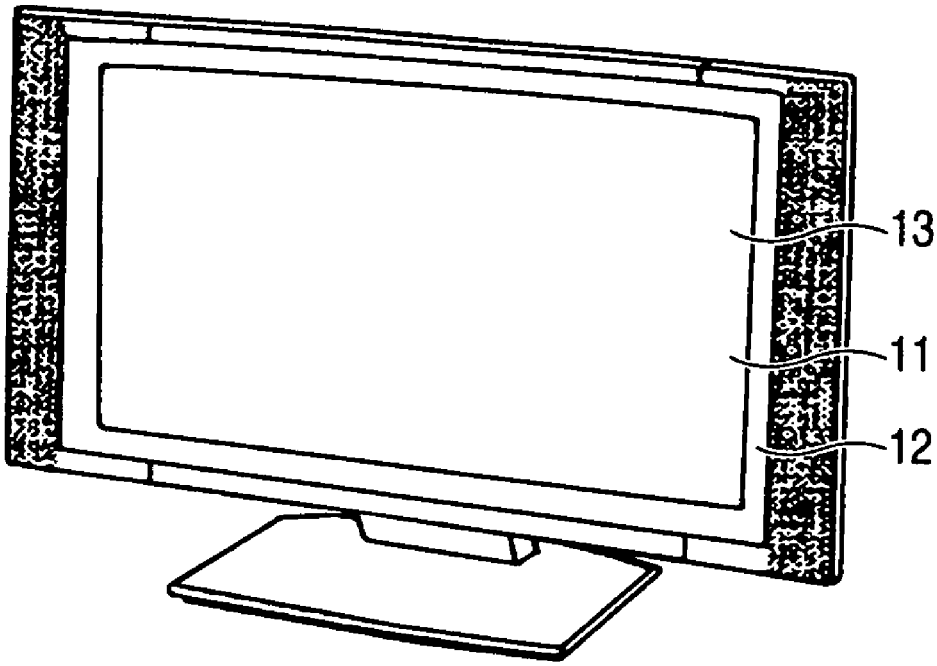
FIG. 13 is a perspective view of a television set equipped with a display device according to an embodiment of the invention.

FIG. 13 shows a television set to which an embodiment of the present invention is applied. The set includes an image display screen 11 including a front panel 12 and a filter glass 13. The television set is fabricated by using a display device according to an embodiment of the present invention in the image display screen 11.

Figure 14:
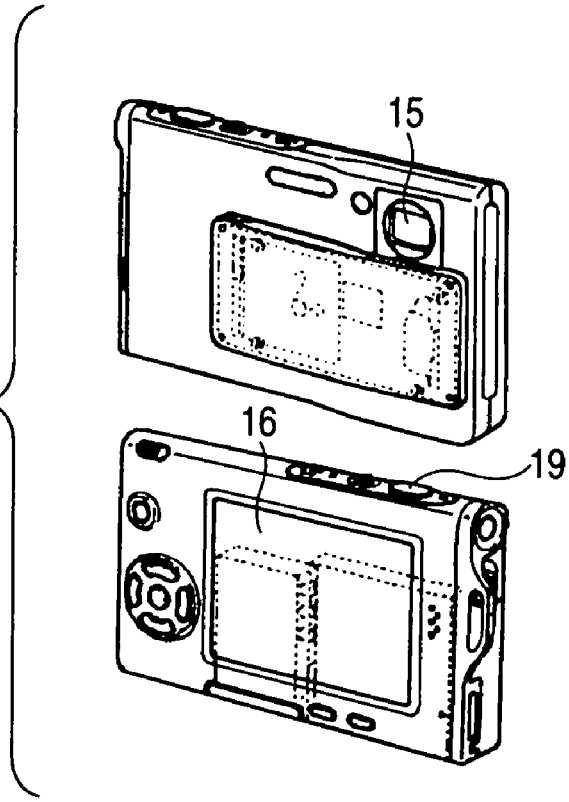
FIG. 14 is a perspective view of a digital still camera equipped with a display device according to an embodiment of the invention.

FIG. 14 shows a digital camera to which an embodiment of the present invention is applied. The upper picture is a front elevation. The lower picture is a rear view. The digital camera includes an imaging lens, a light-emitting portion 15 for a flash, a display portion 16, control switches, a menu switch, and a shutter 19. The digital camera is fabricated by using a display device according to an embodiment of the present invention in the display portion 16.

Figure 15:
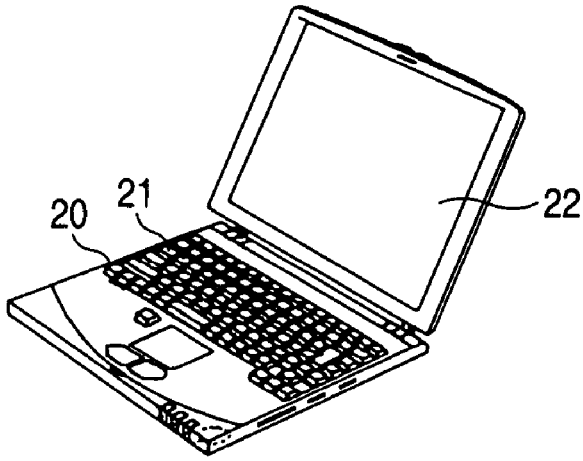
FIG. 15 is a perspective view of a notebook personal computer equipped with a display device according to an embodiment of the invention.

FIG. 15 shows a notebook personal computer to which an embodiment of the present invention is applied. The body 20 of the computer includes a keyboard 21 that is manipulated when alphanumerical characters are entered. The computer further includes a body cover having a display portion 22 on which an image is displayed. The notebook personal computer is fabricated by using a display device according to an embodiment of the present invention in the display portion 22.

Figure 16:
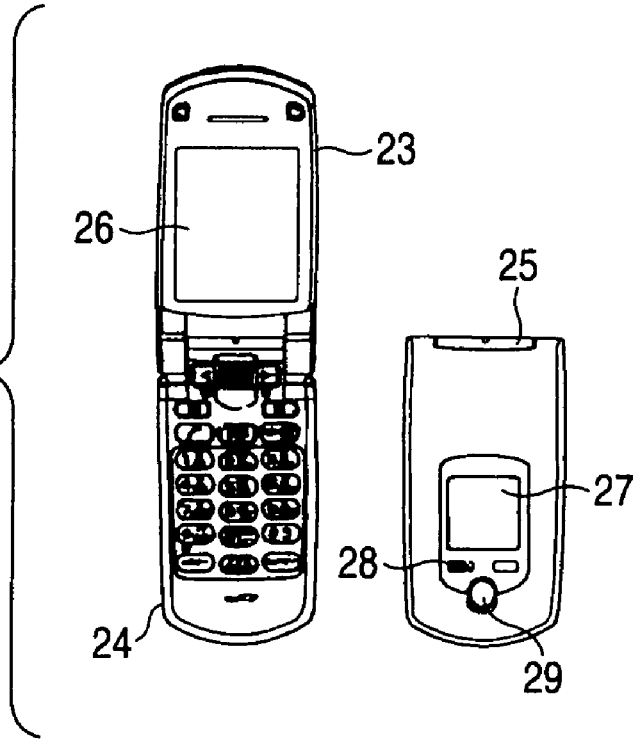
FIG. 16 is a schematic representation of a mobile terminal unit equipped with a display device according to an embodiment of the invention.

FIG. 16 shows a mobile terminal unit to which an embodiment of the present invention is applied. The left picture shows the state in which the cover is opened. The right picture shows the state in which the cover is closed. The mobile terminal unit includes an upper housing 23, a lower housing 24, a connector portion 25 (hinge portion in this example), a display portion 26, a subdisplay portion 27, a picture light 28, and a camera 29. The mobile terminal unit is fabricated by using display devices according to an embodiment of the present invention in the display portion 26 and in the subdisplay portion 27.

Figure 17:
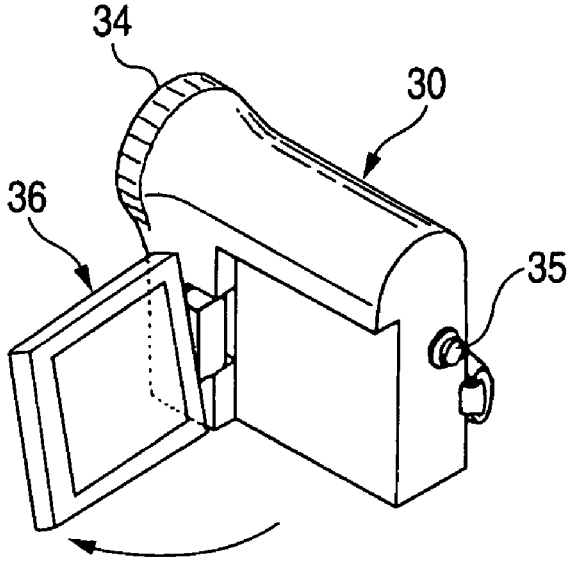
FIG. 17 is a perspective view of a video camera equipped with a display device according to an embodiment of the invention.

FIG. 17 shows a video camera to which an embodiment of the present invention is applied. The video camera includes a body 30, a lens 34 mounted on the front side surface to image the subject, a start-stop switch 35 manipulated during shooting, and a monitor 36. The video camera is fabricated by using a display device according to an embodiment of the invention in the monitor 36.

It should be understood by those skilled in the art that various modifications, combinations, subcombinations and alterations may occur depending on design requirements and other factors insofar as they are within the scope of the appended claims or the equivalents thereof.

What is claimed is:

1. A display device comprising: a pixel array portion; and a driver portion for driving the pixel array portion, wherein the pixel array portion has rows of scanning lines, columns of signal lines, pixels arranged in rows and columns at intersections of the scanning lines and the signal lines, and power lines disposed in a corresponding manner to the rows of the pixels, the driver portion includes a main scanner for supplying a sequential control signal to the scanning lines in horizontal periods to scan successive rows of pixels by a line sequential scanning method, a power-supply scanner for supplying a power-supply voltage to the power-supply lines, the power-supply voltage being switched between a first potential and a second potential in step with the line sequential scanning, and a signal selector for supplying a selector output signal to the columns of signal lines, the selector output signal being switched between a signal potential and a reference potential in step with the line sequential scanning, the signal potential becoming a video signal in each of the horizontal periods, each of the pixels includes a light-emitting device, a sampling transistor, a driving transistor, a retaining capacitor, the sampling transistor has a gate, a source, and a drain, the gate of the sampling transistor is connected with a corresponding one of the scanning lines, one of the source and drain of the sampling transistor is connected with a corresponding one of the signal lines, while the other is connected with the gate of the driving transistor, the driving transistor has a source and a drain, one of the source and the drain of the driving transistor is connected with the light-emitting device, while the other is connected with a corresponding one of the power lines, the retaining capacitor is connected between the source and the gate of the driving transistor, the sampling transistor is brought into conduction according to a control signal supplied from the scanning line, samples the signal potential supplied from the signal line, and retains the sampled potential into the retaining capacitor, the driving transistor receives an electrical current from the power line at the first potential and supplies a driving current into the light-emitting device according to the retained signal potential, the main scanner performs an operation for correcting a threshold voltage for the driving transistor by outputting a control signal to the sampling transistor to bring it into conduction in a time interval in which the power line is at the first potential and, at the same time, the signal line is at the reference potential and retaining a voltage corresponding to the threshold voltage into the retaining capacitor, the main scanner repeatedly performs the operation for correcting the threshold voltage by plural discrete operations in plural horizontal periods preceding sampling of the signal potential to assure that the voltage corresponding to the threshold voltage for the driving transistor is retained into the retaining capacitor, and wherein the main scanner outputs the control signal having a pulse width shorter than a time interval in which the signal line is at the signal potential.

2. A display device as set forth in claim 1, wherein the main scanner outputs the control signal to bring the sampling transistor into conduction in a time interval in which the power line is at the second potential and, at the same time, the signal line is at the reference potential prior to the operation for correcting the threshold voltage, to thereby set the gate of the driving transistor to the reference potential and set the source to the second potential.

3. A display device as set forth in claim 1, wherein the main scanner outputs the control signal having the pulse width shorter than the time interval in which the signal line is at the signal potential to thereby correct the signal potential for mobility of the driving transistor when the signal potential is retained into the retaining capacitor.

4. A display device as set forth in claim 1, wherein the main scanner brings the sampling transistor out of conduction and electrically disconnects the gate of the driving transistor from the signal line when the signal potential is retained into the retaining capacitor to thereby permit the gate potential to respond to variations in the source potential of the driving transistor, whereby the voltage between the gate and source is maintained constant.

5. A method of driving a display device including a pixel array portion and a driver portion for driving the pixel array portion, wherein the pixel array portion has rows of scanning lines, columns of signal lines, pixels arranged in rows and columns at intersections of the scanning lines and the signal lines, and power lines disposed in a corresponding manner to the rows of the pixels, the driver portion includes a main scanner for supplying a sequential control signal to the scanning lines in horizontal periods to scan successive rows of pixels by a line sequential scanning method, a power-supply scanner for supplying a power-supply voltage to the power-supply lines, the power-supply voltage being switched between a first potential and a second potential in step with the line sequential scanning, and a signal selector for supplying a selector output signal to the columns of signal lines, the selector output signal being switched between a signal potential and a reference potential in step with the line sequential scanning, the signal potential becoming a video signal in each of the horizontal periods, each of the pixels includes light-emitting devices, a sampling transistor, a driving transistor, and a retaining capacitor, the sampling transistor has a gate, a source, and a drain, the gate of the sampling transistor is connected with a corresponding one of the scanning lines, one of the source and the drain of the sampling transistor is connected with a corresponding one of the signal lines, while the other is connected with, the gate of the driving transistor, the driving transistor has a source and a drain, one of the source and the drain of the driving transistor is connected with the light-emitting devices, while the other is connected with a corresponding one of the power lines, and the retaining capacitor is connected between the source and the gate of the driving transistor, the method comprising:

bringing the sampling transistor into conduction according to the control signal supplied from the scanning line;

sampling the signal potential supplied from the signal line and retaining the sampled potential into the retaining capacitor;

causing the driving transistor to receive an electrical current from the power line at the first potential and supplying a driving current to the light-emitting devices according to the retained signal potential;

performing an operation for correcting a threshold voltage for the driving transistor by outputting a control signal from the main scanner to bring the sampling transistor into conduction in a time interval in which the power line is at the first potential and, at the same time, the signal line is at the reference potential and retaining a voltage corresponding to the threshold voltage into the retaining capacitor, the control signal output from the main scanner having a pulse width shorter than a time interval in which the signal line is at the signal potential; and causing the main scanner to repeatedly perform the operation for correcting the threshold voltage by plural discrete operations in plural horizontal periods preceding sampling of the signal potential to ensure that the voltage corresponding to the threshold voltage for the driving transistor is retained into the retaining capacitor.

6. An electronic device equipped with a display device as set forth in claim 1.

7. A display device comprising:

rows of scanning lines;

columns of signal lines;

pixels arranged in rows and columns at intersections of the scanning lines and the signal lines; and power lines disposed in a corresponding manner to the rows of the pixels, wherein each of the pixels includes a light-emitting device, a sampling transistor, a driving transistor, and a retaining capacitor, the sampling transistor has a gate, a source, and a drain, the gate of the sampling transistor is connected with a corresponding one of the scanning lines, one of the source and the drain of the sampling transistor is connected with a corresponding one of the signal lines to provide a reference potential and a signal potential, while the other is connected with the gate of the driving transistor, the driving transistor has a source and a drain, one of the source and the drain of the driving transistor is connected with the light-emitting device, while the other is connected with a corresponding one of the power lines, the retaining capacitor is connected between the source and the gate of the driving transistor, wherein a control signal is output to the sampling transistor while the signal line is at the reference potential, to correct a threshold voltage for the driving transistor, wherein correcting the threshold voltage for the driving transistor is carried out by plural discrete operations in plural horizontal periods preceding sampling of the signal potential, and wherein the control signal has a pulse width shorter than a time interval in which the signal line is at the signal potential.

8. A display device comprising:

rows of scanning lines;

columns of signal lines;

pixels arranged in rows and columns at intersections of the scanning lines and the signal lines; and power lines disposed in a corresponding manner to the rows of the pixels, wherein each of the pixels includes a light-emitting device, a sampling transistor providing a reference potential and a signal potential from one of the signal lines, a driving transistor, and a retaining capacitor, the driving transistor is connected between a power line and the light-emitting device, the retaining capacitor is connected between a source and a gate of the driving transistor, and wherein a control signal is output to the sampling transistor while the signal line is at the reference potential, to correct a threshold voltage for the driving transistor, wherein correcting the threshold voltage for the driving transistor is carried out by plural discrete operations in plural horizontal periods preceding a sampling of the signal potential, and wherein the control signal has a pulse width shorter than a time interval in which the signal line is at the signal potential.

* * * * *